US007839301B2

(12) United States Patent
Doherty et al.

(10) Patent No.: US 7,839,301 B2
(45) **Date of Patent: *Nov. 23, 2010**

(54) SURFACE CONDITION SENSING AND TREATMENT SYSTEMS, AND ASSOCIATED METHODS

(75) Inventors: John A. Doherty, Louisville, CO (US); Charles A. Kalbfleisch, Traverse City, MI (US)

(73) Assignee: Western Strategic Products, LLC, Louisville, CO (US)

( * ) Notice: Subject to any disclaimer, the term of this patent is extended or adjusted under 35 U.S.C. 154(b) by 1287 days.

This patent is subject to a terminal disclaimer.

(21) Appl. No.: 11/150,940

(22) Filed: Jun. 13, 2005

(65) Prior Publication Data

US 2005/0246088 A1 Nov. 3, 2005

Related U.S. Application Data

(63) Continuation-in-part of application No. 09/862,652, filed on May 21, 2001, now Pat. No. 6,938,829, which is a continuation of application No. 09/643,154, filed on Aug. 21, 2000, now abandoned, which is a continuation of application No. 09/286,809, filed on Apr. 6, 1999, now Pat. No. 6,173,904, which is a continuation of application No. 08/879,921, filed on Jun. 20, 1997, now Pat. No. 5,904,296, which is a continuation-in-part of application No. 08/783,556, filed on Jan. 14, 1997, now Pat. No. 5,745,051, which is a continuation of application No. 08/660,232, filed on Jun. 7, 1996, now Pat. No. 5,619,193, said application No. 11/150,940 is a continuation-in-part of application No. 10/379,119, filed on Mar. 3, 2003, now Pat. No. 6,977,597, which is a continuation of application No. 09/953,379, filed on Sep. 14, 2001, now Pat. No. 6,538,578, which is a continuation of application No. 09/337,984, filed on Jun. 22, 1999, now Pat. No. 6,535,141, which is a continuation of application No. 09/286,809, filed on Apr. 6, 1999, now Pat. No. 6,173,904.

(60) Provisional application No. 60/031,036, filed on Nov. 18, 1996, provisional application No. 60/020,237, filed on Jun. 21, 1996, provisional application No. 60/000,040, filed on Jun. 8, 1995, provisional application No. 60/004,941, filed on Oct. 6, 1995.

(51) Int. Cl.
*G08G 1/09* (2006.01)

(52) U.S. Cl. ..... 340/905; 340/580; 340/581; 239/1; 239/61; 239/662

(58) Field of Classification Search ..... 340/580, 340/581, 905; 239/1, 61, 662
See application file for complete search history.

(56) References Cited

U.S. PATENT DOCUMENTS

| | | | |
|---|---|---|---|
| 3,160,964 | A | 12/1964 | Boyer et al. |
| 3,519,169 | A | 7/1970 | Holland |
| 3,540,655 | A | 11/1970 | Himrichs |
| 3,655,130 | A | 4/1972 | Patrick |
| 3,856,206 | A | 12/1974 | Bell et al. |
| 3,891,979 | A | 6/1975 | Braun et al. |
| 3,995,569 | A | 12/1976 | Picardat |
| 4,052,003 | A | 10/1977 | Steffen |
| 4,077,139 | A | 3/1978 | Fagervold et al. |
| 4,084,748 | A | 4/1978 | Anderson et al. |
| 4,176,791 | A | 12/1979 | Cattaneo et al. |
| 4,209,065 | A | 6/1980 | Ledent |
| 4,210,284 | A | 7/1980 | Tarnay et al. |
| 4,230,280 | A | 10/1980 | Leigh et al. |
| 4,274,091 | A | 6/1981 | Decker |
| 4,373,668 | A | 2/1983 | Forbes et al. |
| 4,376,007 | A | 3/1983 | Eigenmann |
| 4,391,393 | A | 7/1983 | Filmyer |
| 4,422,562 | A | 12/1983 | Rawson |
| 4,442,979 | A | 4/1984 | Kupper |
| 4,473,319 | A | 9/1984 | Spangler |
| 4,491,275 | A | 1/1985 | Holsworth |
| 4,492,952 | A | 1/1985 | Miller |
| 4,503,806 | A | 3/1985 | Prusak et al. |
| 4,523,280 | A | 6/1985 | Bachman |
| 4,529,336 | A | 7/1985 | Shinozaki et al. |
| 4,553,702 | A | 11/1985 | Coffee et al. |

| | | | | |
|---|---|---|---|---|
| 4,577,781 | A | 3/1986 | Braun | |
| 4,588,127 | A | 5/1986 | Ehrat | |
| 4,678,056 | A | 7/1987 | Kobari et al. | |
| 4,684,062 | A | 8/1987 | Bagwell | |
| 4,690,553 | A | 9/1987 | Fukamizu et al. | |
| 4,700,223 | A | 10/1987 | Shoutaro et al. | |
| 4,700,895 | A | 10/1987 | Takata | |
| 4,733,760 | A | 3/1988 | Inagaki et al. | |
| 4,768,716 | A | 9/1988 | Buchanan, Jr. et al. | |
| 4,803,626 | A | 2/1989 | Bachman et al. | |
| 4,805,088 | A | 2/1989 | Cross et al. | |
| 4,809,197 | A | 2/1989 | Tashiro et al. | |
| 4,829,434 | A | 5/1989 | Karmel et al. | |
| 4,955,538 | A | 9/1990 | Laube et al. | |
| 4,984,163 | A | 1/1991 | Kuwana et al. | |
| 5,012,977 | A | 5/1991 | Karklins et al. | |
| 5,028,017 | A | 7/1991 | Simmons et al. | |
| 5,069,392 | A | 12/1991 | Wise et al. | |
| 5,096,125 | A | 3/1992 | Wise et al. | |
| 5,186,396 | A | 2/1993 | Wise et al. | |
| 5,267,696 | A | 12/1993 | Balmer | |
| 5,310,113 | A | 5/1994 | Cowgur | |
| 5,318,226 | A | 6/1994 | Kime et al. | |
| 5,334,987 | A | 8/1994 | Teach | |
| 5,343,744 | A | 9/1994 | Ammann | |
| 5,366,039 | A | 11/1994 | Sawada | |
| 5,416,476 | A | 5/1995 | Rendon | |
| 5,439,312 | A | 8/1995 | Marcato | |
| 5,447,272 | A | 9/1995 | Ask | |
| 5,449,049 | A | 9/1995 | Every | |
| 5,452,966 | A | 9/1995 | Swisher, Jr. | |
| RE35,100 | E | 11/1995 | Monson et al. | |
| 5,515,623 | A | 5/1996 | Weeks | |
| 5,521,594 | A | 5/1996 | Fukushima | |
| 5,603,452 | A | 2/1997 | Hester | |
| 5,619,193 | A | 4/1997 | Doherty et al. | |
| 5,652,522 | A | 7/1997 | Kates et al. | |
| 5,653,389 | A | 8/1997 | Henderson et al. | |
| 5,684,476 | A | 11/1997 | Anderson | |
| 5,699,056 | A | 12/1997 | Yoshida | |
| 5,745,051 | A | 4/1998 | Doherty et al. | |
| 5,746,539 | A | 5/1998 | Mara | |
| 5,774,070 | A | 6/1998 | Rendon | |
| 5,796,344 | A | 8/1998 | Mann et al. | |
| 5,818,339 | A | 10/1998 | Giles et al. | |
| 5,904,296 | A | 5/1999 | Doherty et al. | |
| 5,928,504 | A | 7/1999 | Hembre et al. | |
| 5,931,393 | A | 8/1999 | Alsip et al. | |
| 5,931,882 | A | 8/1999 | Fick et al. | |
| 5,947,391 | A | 9/1999 | Beck et al. | |
| 5,947,931 | A | 9/1999 | Bierman | |
| 5,955,973 | A | 9/1999 | Anderson | |
| 5,957,621 | A | 9/1999 | Clark, Jr. et al. | |
| 6,089,743 | A | 7/2000 | McQuinn | |
| 6,092,745 | A | 7/2000 | Seymour et al. | |
| 6,166,657 | A * | 12/2000 | Mann | 340/905 |
| 6,173,904 | B1 | 1/2001 | Doherty et al. | |
| 6,236,907 | B1 | 5/2001 | Hauwiller et al. | |
| 6,246,938 | B1 | 6/2001 | Giletta et al. | |
| 6,354,786 | B1 | 3/2002 | Feller | |
| 6,377,881 | B1 | 4/2002 | Mullins | |
| 6,535,141 | B1 | 3/2003 | Doherty | |
| 6,538,578 | B1 | 3/2003 | Doherty | |
| 6,919,821 | B1 * | 7/2005 | Smith | 340/905 |
| 7,164,365 | B2 * | 1/2007 | Doherty et al. | 340/905 |
| 2003/0178501 | A1 | 9/2003 | Doherty | |

FOREIGN PATENT DOCUMENTS

| | | |
|---|---|---|
| CA | 2060418 | 8/1993 |
| CA | 2060418 | 5/1994 |
| CA | 2233689 | 4/1997 |
| CA | 2233689 | 11/2004 |
| CA | 2272541 | 2/2005 |
| DE | 3506229 | 8/1986 |
| FR | 2618543 | 7/1987 |
| FR | 2618543 | 1/1989 |

OTHER PUBLICATIONS

Viking '79 Rover Study Final Report, vol. I, Summary, vol. II, Detailed Technical Volume, NASA CR- 132417, Martin Marietta Corporation, Mar. 1974.
Article, "Just Drive!," by Allen Zeyher, Roads & Bridges, Apr. 2002.
Advertisement, Root Snow Plows.
Mobile GPS Builds on 7400 Technology to Claim the Future of Pavement Management, FactsFinder.
Advertisement, Henderson Manufacturing Reversible Plow.
Advertisement, Henderson Manufacturing Patrol Wing.
Advertisement, Tenco Side Wings.
Advertisement, Tenco Reversible Plow.
Surveyors Use Pedal Power to Map City, ENR, Nov. 13, 1995.
Trimble, AEC Automation Newsletter, Sep. 1995.
GPS Satellites, Trimble Precise Positioning Systems.
GPS Goes Real Time, Civil Engineering, Sep. 1994.
Data Sheet D251, Aanderaa Instruments, Mar. 1995.
UCRL-MI-120916, Lawrence Livermore National Laboratory, Jun. 7, 1995.
Block diagram from Iowa Department of Transportation presentation, Aug. 11, 1999. Advertisement, COMPU-SPREAD™ "Introducing our On board Liquid Pre-Wetting System. C.I.S.—Series," Appears to be available as early as Apr. 1997.
GL 400 Spreader Control Presentation, Component Technology, Appears to be available as early as Mar. 15, 2001.
Advertisement, COMPU-SPREAD™ "Introducing our On board Liquid Pre-Wetting System. C.I.S.—Series," Appears to be available as early as Apr. 1997.
White Paper, "Ice! Alert," Appears to be available as early as 1998.
"SaltMiser™ Operating Instructions," Dec. 8, 1997.
Marketing Document, DIDACTICS Incorporated, " Why SaltMiser?," pp. 1, 3, and 5 of 6 available. Marketing Document, DIDACTICS Incorporated, "Saltmiser™ 2.0 A Real Time Salt Application Controller," Oct. 25, 1997.
Marketing Document, DIDACTICS Incorporated, "IR Applications for Ice and Snow Control," pp. 335-362 available, Appears to be available as early as May 12, 1998.
Brochure, Enator Telub AB, "Mobile Road Condition Monitoring," Appears to be available as early as 1998.
Article, "Better bridge deicing on the way?" Better Roads, Jun. 1995.
Advertisement, Passport 5000, "Only Passport 5000 Gives You the Total Picture," 1995.
Article, "Americans can Learn a Lot from European, Japanese Snowfighters, " by Leland D. Smithson, P.E., Roads & Bridges, pp. 30-32 available, Jun. 1995.
Article, "Developments Improve Road Weather Information Systems," Betters Roads, pp. 21 and 24 available, Oct. 1995.
Draft Proposal, Policy Recommendations to the RAQC Concerning the Comprehensive Long Range Air Quality Plan, from the Street Sanding/Cleaning Subcommittee City of Aurora Public Works Dept. (Colorado), Nov. 1, 1995.
Article, "RWIS helps with snow and ice control," Better Roads, Sep. 1994.
Brochure, Tell Temp 750, Geneva Scientific, Oct. 1994.
Brochure, "Artificial Intelligence/Expert Systems," Kaman Sciences Corporation, Copyright 1991.
Article, "Traffic Sensor System," Better Roads, Dec. 1995.
Article, "The View From Space Satellites keep eye on earthly activity," USA Today. Article, "Riding the Data Highway," Newsweek, p. 97, Mar. 21, 1994.
Picture diagram, "One-Second Emissions Test," Denver Post, May 7, 1995.
Article, "Colorado Hosts Pilot Workshop Pavement Preventive Maintenance: An Idea Whose Time Has Come," Focus, US Department of Transportation Federal Highway Administration, Aug. 1995.
Article, "Innovations in ITS," ITE Journal, Dec. 1996.

Brochure, "KEMS . . . A Geographic Information System Tailored for Emergency Management Applications," Kaman Sciences Corporation. Article, "Measuring Salt's Effectiveness in New York," Better Roads, Jan. 1995.
Excerpts from America Online: KKlean, Jun. 30, 1995.
Article, "Clementine Searches for Ice on Moon," by Jane E. Allen, Sunday Camera, Apr. 17, 1994.
Article, entitled "Cellular technology has new niche, Phones offer mobile control in rural Colorado," by Dinah Zeiger, Denver Post, Aug. 21, 1994.
Article, "Columbia/HCA system speeds test result delivery," USA Today, Nov. 11, 1994.
Article, "Danger—Black Ice!" Traffic Technology International, 1994.
Article, "New Horizons at Harris," by Bernie Ward, Sky, Dec. 1994.
Kaman Annual Report, 1993.
Article, "Humidity and Pressure Measurement," Vaisala News, 1992.
Kaman, A Technology Company, Fact Book, 1993.
Article, "The Snow on Pluto," by Jeffrey Winters, Discover, Jan. 1997.
Article, "Water, Pure and Simple," by Ashok Gadgil, Discover, pp. 87-88, Jul. 1996.
Article, "One Very Cold Lake," by Kathleen Spiessbach, Discover, p. 26, Jan. 1997.
Article, "Perpetual Flight," by Kathy A. Svitil, Discover, p. 38, Nov. 1996.
Advertisement, Cole-Parmer Instrument Company, re: Cole-Parmer Low-Cost Infrared Thermometers, 1997.
Brochure, Southwest Research Institute—Guide, 13 pages, Aug. 1996.
Brochure, Southwest Research Institute—Guide, 13 pages, Jan. 1998.
Brochure, "Facts About Southwest Research Institute," Southwest Research Institute, San Antonio, Texas. Annual Report from Southwest Research Institute, 1996.
Annual Report from Southwest Research Institute, 1997.
Feedback on article, "Managing Winter Weather" and "Visibility a Key Component of Weather Systems," by John D. Crosby, Dec. 1996.
Article, "Ordinary Vinegar Found Among Stars," by Paul Recer.
Brochure, "Solving Today's Problems for Tomorrow's Safety," Control Products, Inc.
Advertisement, "Are You Still Detecting Icy Roads Between Pavement Sensors by the Seat of Your Pants?" Vaisala.
Brochure, "Better Roads . . . Safer Roads . . . More Cost Effective Roads . . . Through Innovations in Technology," Federal Highway Administration.
Article, "Sensors to Help State Keep Ahead of Storms," by Ed Vogel.
Brochure, "Autoscope," Econolite Control Products, Inc.
Brochure, "Playing with Fire—Science and Politics of Air Pollution from Cars".
Article, "Out Front—What's Happening in the World of ITS".
Article, "New Auto Technology Helps Guide Driver, Avoid Crashes," by Earle Eldridge, USA Today.
Advertisement, "Hand-Held Autoranging Conductivity Meters".
Instruction Manual from Coralba ab, Sweden, "Instructions for C-u Friction Tester".
Advertisement, VIBRO-METER SA, Fribourg, Switzerland.
Scan FP 2000 Sensor Advertisement, Surface Systems Inc.
Brochure, "425 Ultrasonic Wind Sensor".
Article, "Magnetic strips make snow ploughs smarter", ITS: Intelligent transport systems, Jan./Feb. 1997.
Article, "ITS applications for magnetic tape", ITS: Intelligent transport systems, Jan./Feb. 1997.
Article, "UK proposes three private traffic control centres", ITS: Intelligent transport systems, Jan./Feb. 1997.
Article, "Crash warning system set for sale in Europe and Japan", ITS: Intelligent transport systems, Jan./Feb. 1997.
Brochure, "425 Ultrasonic Wind Sensor", Jun. 14, 1996.
Advertisement, Root Snow Plows, Mar. 1995.
Mobile GPS Builds on 7400 Technology to Claim the Future of Pavement Management, FactsFinder, date unknown.
Advertisement, Henderson Manufacturing Reversible Plow, 1997.
Advertisement, Henderson Manufacturing Patrol Wing, 1997.
Advertisement, Tenco Side Wings, 1994.
Advertisement, Tenco Reversible Plow, believed available about 1994.
"GPS Satellites . . . They're Taking Control of Our Machines", Trimble Precise Positioning Systems, Cahners Publishing Company, 1996.
Advertisement, Vibro-Meter SA, Fribourg, Switzerland, date unavailable.
Scan FP 2000 Sensor Advertisement, Surface Systems Inc., date unavailable.
Article, "Calibration to Automation", Road & Bridges, Jun. 1999.
Block diagram from Iowa Department of Transportation presentation, Aug. 11, 1999.
Advertisement, Compu-Spread™., "Introducing our On board Liquid Pre-Wetting System. C.I.S.—SERIES," Appears to be available as early as Apr. 1997.
"SaltMiser.™. Operating Instructions," Dec. 8, 1997.
Marketing Document, DIDACTICS Incorporated, "Why SaltMiser?," pp. 1,3, and 5 of 6 available.
Marketing Document, DIDACTICS Incorporated, "Saltmiser.™. 2.0 A Real Time Salt Application Controller," Oct. 25, 1997.
Article, "Roads Report," edited by Larry Flynn, Roads & Bridges, Mar. 1993.
Article, "The View From Space Satellites keep eye on earthly activity," USA Today.
Article, "Riding the Data Highway," Newsweek, p. 97, Mar. 21, 1994.
Brochure, "KEMS . . . A Geographic Information System Tailored for Emergency Management Applications," Kaman Sciences Corporation.
Article, "Measuring Salt's Effectiveness in New York," Better Roads, Jan. 1995.
Brochure, "Facts About Southwest Research Institute," Southwest Research Institute, San Antonio, Texas.
Annual Report from Southwest Research Institute, 1996.
Article, "New Auto Technology Helps Guide Drivers, Avoid Crashes," by Earle Eldrige, USA Today.
Advertisement, "Hand-Held Autoranging Conductivity Meters".
Instruction Manual from Coralba ad, Sweden, "Instructions for C-u Friction Tester".
Notice of Allowance, U.S. Appl. No. 08/660,232 (now U.S. Pat. No. 5,619,193), Oct. 16, 1998.
Examiner's Amendment, U.S. Appl. No. 08/660,232 (now U.S. Pat. No. 5,619,193), Oct. 3, 1996.
Notice of Allowance, U.S. Appl. No. 08/783,556 (now U.S. Pat. No. 5,745,051), Oct. 28, 1997.
Examiner's Amendment, U.S. Appl. No. 08/783,556 (now U.S. Pat. No. 5,745,051), Oct. 20, 1997.
Amendment under 37 CFR § 1.115, U.S. Appl. No. 08/783,556 (now U.S. Pat. No. 5,745,051), Aug. 26, 1997.
Office Action, U.S. Appl. No. 08/783,556 (now U.S. Pat, No. 5,745,051), May 30, 1997.
Notice of Allowance, U.S. Appl. No. 08/879,921 (now U.S. Pat. No. 5,904,296), Dec. 8, 1998.
Response to Office Action, U.S. Appl. No. 08/879,921 (now U.S. Pat. No. 5,904,296), Oct. 16, 1998.
Office Action, U.S. Appl. No. 08/879,921 (now U.S. Pat. No. 5,904,296), Oct. 1, 1998.
Response to Office Action, U.S. Appl. No. 08/879,921 (now U.S. Pat. No. 5,904,296), Jul. 15, 1998.
Office Action, U.S. Appl. No. 08/879,921 (now U.S. Pat. No. 5,904,296), Apr. 15, 1998.
Examiner's Amendment, U.S. Appl. No. 09/826,809 (now U.S. Pat. No. 6,173,904), Aug. 7, 2000.
Notice of Allowance, U.S. Appl. No. 09/826,809 (now U.S. Pat. No. 6,173,904), Apr. 21, 2000.
Response to Office Action, U.S. Appl. No. 09/826,809 (now U.S. Pat. No. 6,173,904), Apr. 5, 2000.
Office Action, U.S. Appl. No. 09/826,809 (now U.S. Pat. No. 6,173,904), Jan. 5, 2000.
Response to Office Action, U.S. Appl. No, 09/826,809 (now U.S. Pat. No. 6,173,904), Oct. 25, 1999.
Office Action, U.S. Appl. No. 09/826,809 (now U.S. Pat. No. 6,173,904), Jun. 25, 1999.

Office Action, U.S. Appl. No. 09/643,154 (abandoned), Nov. 20, 2000.
Notice of Allowance, U.S. Appl. No. 09/862,652 (now U.S. Pat. No. 6,938,829), Jan. 25, 2005.
Response to Office Action, U.S. Appl. No. 09/862,652 (now U.S. Pat. No. 6,938,829), Jan. 4, 2005.
Office Action, U.S. Appl. No. 09/862,652 (now U.S. Pat. No. 6,938,829), Aug. 4, 2004.
Response to Office Action, U.S. Appl. No. 09/862,652 (now U.S. Pat. No. 6,938,829), May 20, 2004.
Office Action, U.S. Appl. No. 09/862,652 (now U.S. Pat. No. 6,938,829), Nov. 20, 2003.
Response to Restriction Requirement, U.S. Appl. No. 09/862,652 (now U.S. Pat. No. 6,938,829), Aug. 28, 2003.
Restriction Requirement, U.S. Appl. No. 09/862,652 (now U.S. Pat. No. 6,938,829), Jun. 3, 2003.
Notice of Allowance, U.S. Appl. No. 09/337,987 (now U.S. Pat. No. 6,535,141), Dec. 4, 2002.
Examiner's Amendment, U.S. Appl. No. 09/337,987 (now U.S. Pat. No. 6,535,141), Dec. 2, 2002.
Response to Office Action, U.S. Appl. No. 09/337,987 (now U.S. Pat. No. 6,535,141), Oct. 16, 2002.
Office Action,U.S. Appl. No. 09/337,987 (now U.S. Pat. No. 6,535,141), May 31, 2002.
Amendment, U.S. Appl. No. 09/337,987 (now U.S. Pat. No. 6,535,141), May 24, 2002.
Response to Office Action, U.S. Appl. No. 09/337,987 (now U.S. Pat. No. 6,535,141), Apr. 11, 2002.
Office Action,U.S. Appl. No. 09/337,987 (now U.S. Pat. No. 6,535,141), Jan. 23, 2002.
Response to Office Action, U.S. Appl. No. 09/337,987 (now U.S. Pat. No. 6,535,141), Oct. 22, 2001.
Office Action and Notice of Non-responsive Amendment, U.S. Appl. No. 09/337,987 (now U.S. Pat. No. 6,535,141), Sep. 24, 2001.
Response to Office Action, U.S. Appl. No. 09/337,987 (now U.S. Pat. No. 6,535,141), Sep. 14, 2001.
Declaration of Lee Osman submitted with Response to Office Action, U.S. Appl. No. 09/337,987 (now U.S. Pat. No. 6,535,141), Sep. 14, 2001.
Declaration of J. Doherty submitted with Response to Office Action, U.S. Appl. No. 09/337,987 (now U.S. Pat. No. 6,535,141), Sep. 14, 2001.
Office Action, U.S. Appl. No. 09/337,987 (now U.S. Pat. No. 6,535,141), Mar. 14, 2001.
Notice of Allowance, U.S. Appl. No. 09/953,379 (now U.S. Pat. No. 6,538,578), Jan. 9, 2003.
Interview Summary, U.S. Appl. No. 09/953,379 (now U.S. Pat. No. 6,538,578), Oct. 31, 2002.
Supplemental Amendment, U.S. Appl. No. 09/953,379 (now U.S. Pat. No. 6,538,578), Oct. 15, 2002.
Response to Office Action, U.S. Appl. No. 09/953,379 (now U.S. Pat. No. 6,538,578), Sep. 10, 2002.
Office Action, U.S. Appl. No. 09/953,379 (now U.S. Pat. No. 6,538,578), Jul. 26, 2002.
Notice of Allowance, U.S. Appl. No. 10/379,119 (now U.S. Pat. No. 6,977,597), Jul. 22, 2005.
Amendment and Response, U.S. Appl. No. 10/379,119 (now U.S. Pat. No. 6,977,597), Apr. 24, 2004.
Office Action, U.S. Appl. No. 10/379,119 (now U.S. Pat. No. 6,977,597), Oct. 22, 2003.
Notice of Allowance, U.S. Appl. No. 11/273,364 (now U.S. Pat. No. 7,164,365), Sep. 5, 2006.
Amendment and Response, U.S. Appl. No. 11/273,364 (now U.S. Pat. No. 7,164,365), Jul. 28, 2006.
Office Action, U.S. Appl. No. 11/273,364 (now U.S. Pat. No. 7,164,365), May 2, 2006.
Notification of Transmittal of International Search Report *and* International Search Report, PCT/US96/15985, Jan. 17, 1997.
Notification of Transmittal of International Preliminary Examination Report *and*International Preliminary Examination Report , PCT/US96/15985, Jan. 14, 1998.
Response to Official Action, Canadian Serial No. 2,233,689 (now Canadian Pat. No. 2,233,689), Jan. 15, 2004.
Official Action, Canadian Serial No. 2,233,689 (now Canadian Pat. No. 2,233,689), Jul. 16, 2003.
Response to Official Action, Canadian Serial No. 2,233,689 (now Canadian Pat. No. 2,233,689), Feb. 17, 2003.
Official Action, Canadian Serial No. 2,233,689 (now Canadian Pat. No. 2,233,689), Aug. 27, 2002.
Response to Official Action, Canadian Serial No. 2,233,689 (now Canadian Pat. No. 2,233,689), Jun. 12, 2002.
Official Action, Canadian Serial No. 2,233,689 (now Canadian Pat. No. 2,233,689), Feb. 12, 2002.
Written Opinion, PCT/US97/21144, Sep. 28, 1998.
Notification of Transmittal of International Search Report *and* International Search Report, PCT/US97/21144, Apr. 27, 1998.
Response to Official Action, Canadian Serial No. 2,272,541 (now Canadian Pat. No. 2,272,541), Mar. 25, 2004.
Official Action, Canadian Serial No. 2,272,541 (now Canadian Pat. No. 2,272,541), Sep. 29, 2003.
Response to Official Action, Canadian Serial No. 2,272,541 (now Canadian Pat, No. 2,272,541), May 27, 2003.
Official Action, Canadian Serial No. 2,272,541 (now Canadian Pat. No. 2,272,541), Nov. 28, 2002.
Response to Official Action, Canadian Serial No. 2,272,541 (now Canadian Pat. No. 2,272,541), Aug. 20, 2002.
Official Action, Canadian Serial No. 2,272,541 (now Canadian Pat. No. 2,272,541), Feb. 27, 2002.
National Science Foundation; "Researcher Uses 'Doppler on Wheels' To Stare Hurricane Georges in the Eye"; Science Daily; Sep. 26, 1998; 2 pages; http://www.sciencedaily.com/releases/1998/09/980926063202.htm.
Rasmussen, Erik; "Mobile Doppler Radar: A new tool to investigate tornadic storms"; NSSL Briefings; Fall/Winter 1995; pp. 10-11.
Notice of Allowance issued in related U.S. Appl. No. 11/932,240, issued Nov. 3, 2009, 7 pages.
U.S. Appl. No. 11/932,240, Preliminary Amendment filed Mar. 16, 2009, 10 pages.
U.s. Appl. No. 11/932,240, Office Action mailed May 15, 2009, 11 pages.
U.S. Appl. No. 11/932,240, Response to Office Action filed Jul. 30, 2009, 8 pages.
U.S. Appl. No. 11/513,697, Notice of Allowance mailed Mar. 12, 2008.
Canadian Application No. 2,312,453, Preliminary Amendment, Jun. 27, 2005, 12 pages.
Canadian Application No. 2,312,453, Office Action, Aug. 5, 2008, 2 pages.
Canadian Application No. 2,312,453, Response to Office Action, Feb. 4, 2009, 43 pages.
Canadian Application No. 2,312,453, Voluntary Amendment, Apr. 2, 2009, 41 pages.
Canadian Application No. 2,482,691, Office Action, Apr. 2, 2009, 1 page.

* cited by examiner

*Primary Examiner*—Steven J Ganey
(74) *Attorney, Agent, or Firm*—Lathrop & Gage LLP

(57) ABSTRACT

A surface condition sensing and treatment system includes a transmitter for transmitting electromagnetic radiation (EMR) toward a surface material disposed upon a vehicle travel surface. Reflected EMR is received and signals indicative of the reflected EMR are processed to produce output corresponding to a characteristic of the surface material. Characteristics include friction, depth and composition, including ice present in the surface material. Sensing may be locally or remotely, automatically or manually initiated. The system may include a display and at least one computer with a database of surface material characteristics, historical, environmental and GIS positional information. Sensed characteristics processed with database information may determine a surface treatment, according to a selected outcome or level of service. A spreader system applies the surface treatment responsive to local, remote, automatic or manual command. The system may be mounted with a vehicle, and may sense surface conditions while the vehicle is in motion.

70 Claims, 19 Drawing Sheets

SURFACE CONDITION SENSING AND TREATMENT SYSTEMS, AND ASSOCIATED METHODS

CROSS REFERENCE TO RELATED APPLICATIONS

This application is a continuation-in-part of U.S. patent application Ser. No. 09/862,652, filed May 21, 2001, now U.S. Pat. No. 6,938,829, which is a continuation of U.S. Ser. No. 09/643,154, filed Aug. 21, 2000, now abandoned, which is a continuation of U.S. Ser. No. 09/286,809, filed Apr. 6, 1999 and now U.S. Pat. No. 6,173,904, which is a continuation of U.S. Ser. No. 08/879,921, filed Jun. 20, 1997, now U.S. Pat. No. 5,904,296, which claims priority to U.S. Provisional Ser. Nos. 60/031,036, filed Nov. 18, 1996 and 60/020,237, filed Jun. 21, 1996, and which is also a continuation-in-part of U.S. Ser. No. 08/783,556, filed Jan. 14, 1997, now U.S. Pat. No. 5,745,051, which is a continuation of U.S. Ser. No. 08/660,232, filed Jun. 7, 1996, now U.S. Pat. No. 5,619,193, which claims priority to U.S. Provisional Ser. Nos. 60/000,040, filed Jun. 8, 1995, and 60/004,941, filed Oct. 6, 1995. This application is also a continuation-in-part of U.S. patent application Ser. No. 10/379,119, filed Mar. 3, 2003, now U.S. Pat. No. 6,977,597, which is a continuation of U.S. Ser. No. 09/953,379, filed Sep. 14, 2001, now U.S. Pat. No. 6,538,578, which is a continuation of U.S. Ser. No. 09/337,984, filed Jun. 22, 1999, now U.S. Pat. No. 6,535,141, which is also continuation of U.S. Ser. No. 09/286,809, filed, Apr. 6, 1999, now U.S. Pat. No. 6,173,904, noted herein above. Each of the above-referenced patents and patent applications are incorporated herein by reference.

BACKGROUND

A number of attempts have been made to sense the condition of surfaces for vehicular travel, such as roadways and aircraft runways, during changing or adverse weather conditions. For example, existing warning systems on road vehicles such as cars and trucks may detect basic moisture and temperature factors. Some examples of such systems are disclosed in U.S. Pat. Nos. 4,492,952 and 4,678,056. One particular system, disclosed in U.S. Pat. No. 5,216,476, employs an infrared sensor which is mounted on the exterior of the vehicle and sends a signal to a microprocessor which then can display the temperature of the road surface.

Alternately, in maintenance applications, conductivity, temperature and other sensors may be placed either in a road surface or adjacent the road to monitor the temperature of the road surface and/or monitor whether there is ice forming on the surface. This information is fed to a center for control and dispatch of trucks to apply salt, sand or other deicing mixtures. At airports, these systems may warn maintenance crews that the runways need to be treated or alert staff that deicing procedures need to be implemented. Some conventional treatment systems have a supply of chemicals and pumps beside the roadway to automatically spray the road when triggered by a sensor. Alternately, deicing or other conditioning treatments (such as friction enhancing treatments) may be applied from surface conditioning vehicles, which often include material spreaders.

Surface conditioning vehicles with material spreaders may also be used to provide pesticide and fertilizer spreaders in agricultural applications. In either agricultural or roadway/runway maintenance applications, it is often desirable to spread multiple treatment materials upon the surface, simultaneously. In many instances, each material has its own delivery system, and parameters for application of each material, such as amount and spread width, must be independently set by an operator. In the event the surface condition changes, for example due to change in the width or composition of the surface, the operator must modify the application of each treatment material separately.

SUMMARY

In one embodiment, a surface condition sensing and treatment system for sensing at least one characteristic of a surface material on a vehicle travel surface includes a transmitter, a receiver and at least one first signal processor connected to the receiver. The transmitter transmits electromagnetic radiation (EMR) toward the surface material. The receiver receives reflected EMR, and the at least one first signal processor processes data indicative of the reflected EMR to produce output corresponding to the characteristic of the surface material.

In one embodiment, a method for remotely sensing one or more characteristics of a travel surface includes transmitting EMR toward the surface material; receiving reflected electromagnetic radiation from the surface material, and processing data indicative of the reflected electromagnetic radiation to produce output corresponding to the one or more characteristics of the surface material.

In one embodiment, a method of mobile control of a surface conditioning device includes sensing at least one characteristic of a surface material on a vehicle travel surface; transmitting an output signal based upon the sensed characteristic, and receiving the output signal at a remote unit. The method further includes analyzing the output signal to determine a surface conditioning treatment for modifying the sensed characteristic; transmitting a treatment command to a vehicle; and applying one or more treatment materials from the vehicle to the travel surface based upon the treatment signal.

DETAILED DESCRIPTION

Figure 1A:
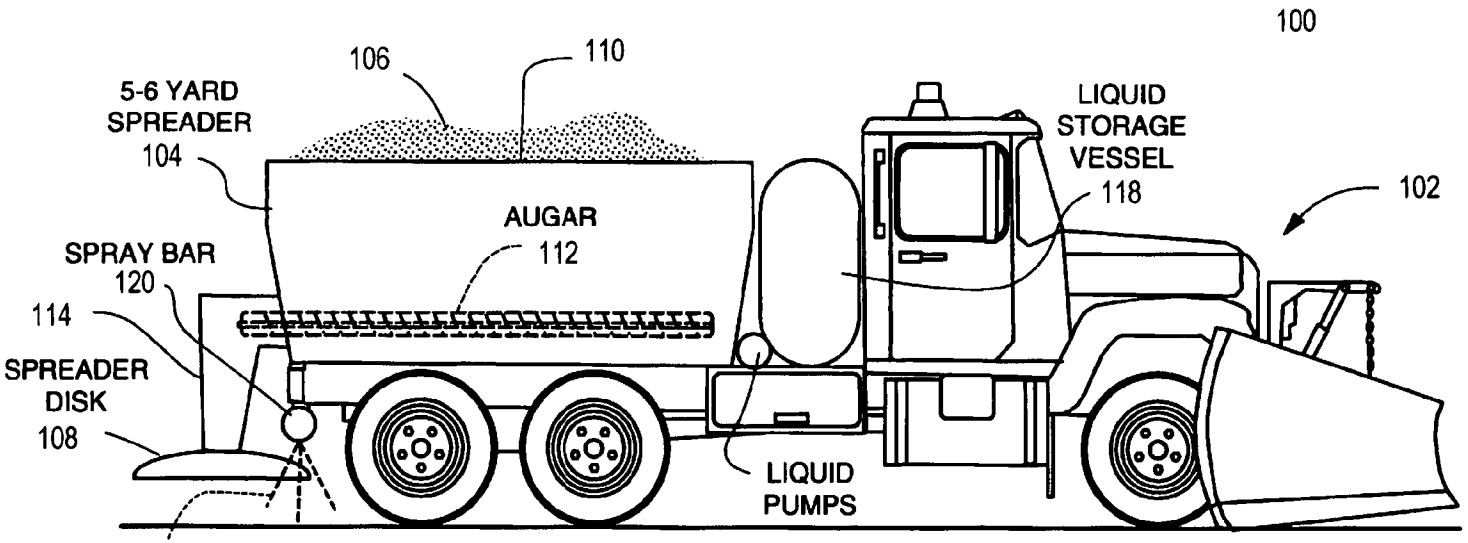
FIG. 1A is a side view of a vehicle with a material spreader, operable with a surface condition sensing and treatment system.
Figure 1B:
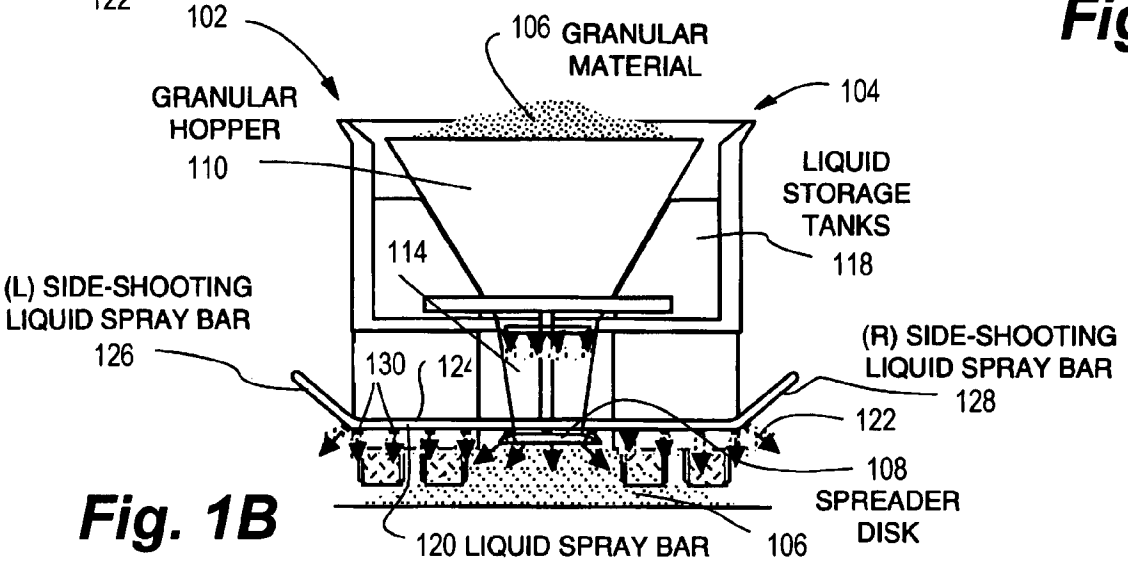
FIG. 1B is a rear-end view of the embodiment of FIG. 1A.

A surface condition sensing and treatment system may be mounted with a conditioning or service vehicle 102, illustratively shown in FIGS. 1A and 1B as a truck with a plow and spreader system. Control of dispensing granular and/or liquid materials from a conditioning vehicle using a surface condition sensing and treatment system is further described herein below, for example, with respect to FIGS. 2 and 5-10. For ease of description, general operation of a conditioning vehicle with a synchronized spreader system, as described in U.S. Pat. No. 5,904,296, is first summarized.

Conditioning vehicle 102 is shown as a truck with a plow and synchronized spreader system; however, it is to be understood that the mobile sensing and conditioning system may also be utilized elsewhere, such as with other vehicle types and material distribution systems, including snow plows, conditioning vehicles equipped with blowers, and agricultural vehicles such as tractors and plows. Throughout this specification, the term "vehicle" is meant inclusively to refer to any moving vehicle.

The surface condition sensing and treatment system may facilitate synchronized application of treatment materials, either solid or liquid, to a surface such as a runway or roadway in proportional amounts or spatially distributed proportions in response to user defined requirements and/or operation of a vehicle mounted component in response to conditions encountered in real time. Manual or automatic coordinated application of a plurality of materials to a surface, separately or simultaneously, and in desired proportions and/or widths may occur in real time. Optionally, application may be delayed until a chosen point in the future, for example, application may be postponed until a selected time, or until a selected condition is detected.

Further, the surface condition sensing and treatment system, and associated methods, may be used not only in the arena of controlling snow and ice on roadways, but also for many different uses such as crop fertilizing, ground conditioning during road construction, road surface monitoring, etc. It is to be understood that said systems and associated methods may equally well be utilized for these and other purposes where the distribution of one or more conditioning materials is desired.

Referring again to the embodiment of FIGS. 1A and 1B, a conditioning vehicle 102 includes a system for storing and spreading granular material 106, as well as a system for storing and spreading liquid material 122, illustratively shown as combined material distribution system 104. Vehicle 102 may store and dispense one liquid or granular material, or store and dispense types of granular and/or fluid materials; usually it has the capability of storing and dispensing (synchronously or not) at least two different materials. For example, material distribution system 104 may include one granular fluid material and one liquid fluid material. It is to be understood that a single granular material, a single liquid material, or more than two materials as well as any combination of granular and/or liquid materials may also be utilized.

Granular material 106 dispensed from vehicle 102 may use a spinning disk 108; material 106 may also be dispensed by other means such as gravity and/or air pressure. The granular material 106 is typically a granular chemical or abrasive material. The granular material 106 stored in the hopper 110 is conveyed, such as by an auger 112, to a dispensing chute 114 at the rear of the truck through which it falls into contact with the spinning spreader disk 108. Rotation of the spreader disk 108 may be caused by any of a variety of means, including an electric motor, air pressure, and/or hydraulic pressure. Other dispensing mechanisms may also be used in place of the spreader disk 108. For example, two rotating belts that trap the material and sling it out behind the truck may be used. Alternatively, the material may be propelled from the storage hopper or container out through an orifice via air pressure or through venturi action, for example.

Spreader disk 108 may spin about its center, generally vertical axis and impart a tangential force to the granular material as it falls onto the disk. The granular material is for example spread or spewn over a path width, which may be determined locally or remotely, with a surface condition sensing and treatment system, according to the geographic location of conditioning vehicle 102. The spread of granular material over the determined path width may be achieved in part by varying the speed of rotation of the spreader disk 108 according to parameters of the granular material, such as density. The width of spread of the granular material 106, or liquid material 122, may be measured in a direction transverse to the length of the vehicle 102, and is typically analogous to the width dimension of a road or other surface upon which the vehicle 40 travels. For instance, in FIG. 1B, the spreader disk 108 may deliver granular material in a path having an arc width equal to the width of the vehicle 102. The material may also be projected rearwardly (to facilitate a lower or zero-velocity impact with the ground), forwardly, or at any angle from the truck. U.S. Pat. No. 5,904,296, incorporated herein by reference, provides useful description of spreading means, dispensing mechanisms and determination of spread width.

Liquid material 122 may be stored in and dispensed from a liquid storage vessel 118 positioned on the vehicle 102 behind the cab of the vehicle, in front of the hopper 110, as shown in FIG. 1A. Alternatively, the liquid storage vessel 118 may be bifurcated and positioned along the length of the vehicle on the outer sides of the granular hopper, as is shown in FIG. 1B. Other positions may be utilized for liquid storage vessel 118, or the vessel 118 may form part of the structural portion of the granular hopper 110 or a structural portion of the vehicle 102.

A spray bar 120 extends laterally at the rear end of the vehicle 102 and is generally adjacent to the spreader disk 108, as shown in FIG. 1A. The spray bar 120 may also be formed by a vertical stack of smaller spray bars and nozzles. The spray bar 120 may have side shooting extensions 126 and 128 attached at its opposite ends to allow liquid 122 to be sprayed at a greater width through the spray bar. The position of liquid spray bar 120 may also be locally or remotely variable via the surface condition sensing and treatment system described herein, so that it may extend at any angle from the truck, to create any number of orientations. For example, spray bar 120 may be vertically oriented for spraying roadside vegetation or shoulder areas. FIGS. 1A and 1B illustrate a typical transverse spray bar position for a flat road surface.

For example, in FIG. 1B, spray bar 120 has a center portion 124 and two remotely movable side spraying portions 126, 128. The spray bar 120 may be a tube which has nozzles or apertures 130 formed therein to allow the liquid flowing through the spray bar 120 to spray onto the road surface. The side spraying extensions 126, 128 are for example rotatably attached at either end of the spray bar central portion 124 and are in fluid communication with the center portion 124 of the spray bar 120 in positions when a single central pump is utilized. When separate pumps are utilized, the central portion 124 need not be in fluid communication with the end portions 126 and 128. A series of remotely operable baffles or valves such as solenoid valves are positioned within the spray bar 120 adjacent to or as part of each nozzle 130 to facilitate changing the width of spray emanating from the spray bar 120. The width of spray may be controlled via the surface condition sensing and treatment systems described herein below, by either operator or automated control. The valves or flow restrictors such as baffles may optionally be placed at discreet positions along the length of the spray bar 120, and include positions in the left or right end portions 126, 128 of the spray bar 120. The position of spray bar 120 may be varied and further width variation may be achieved (e.g., by operably moving the valves, flow restrictors or baffles or other flow control devices along the length of the liquid spray bar 120), for example, in response to characteristics sensed via a transmitter such as transmitter 202, described with respect to FIG. 2, below. Variation in width is further described in U.S. Pat. No. 5,904,296, and further herein below with respect to FIGS. 4A-4F.

Liquid material 122 may be for example conveyed from the liquid storage vessel 118 to the spray bar 120 through conventional piping by positive displacement, centrifugal liquid pump (which pumps the liquid material from the storage vessel to the spray bar), or by pressure (such as selectively pressurizing the liquid storage vessel itself), or by gravity feed (which would force the liquid through the piping to the spray bar 120). The liquid may alternatively be spread by another rotating disk (not shown), in which case the spray bar 120 or set of spray bars may be replaced with at least one rotating nozzle disk or set of disks, and the spread width of the liquid material 122 may thus depends on the disk orientation and placement and speed of the rotating disk in an analogous fashion to the rotating disk 108 used with the granular material as well as the discharge pressure and orifice size. Other means of spreading the liquid material may also be utilized such as through a selectable set of variable orifice discharge nozzles and/or flow control valves mounted on the truck.

The spread distance or spray path width of the liquid dispensing system for a given type of material depends upon the orientation of spray bar 120 and/or nozzles 130, and both the pressure at which the liquid material 122 is forced through the pipe system and into the spray bar 120, and the selective activation of the valves or baffles found on or inside the spray bar 120. The spray bar 120 may receive fluid from the center piping connection such that any width control mechanism may be positioned along the length of the spray bar relative to the location of the connection between the piping system and the spray bar.

For ease of description in this specification, the center of the spread-width for the granular material 44 and the center of the spread-width for the liquid material 57 are positioned co-extensively with one another at the rear of the vehicle 40.

In general, the synchronized-width material spreader works via the surface condition sensing and treatment system, either manually or optionally automatically, to control the spread-width and direction of any second or nth granular or liquid material based on the change of spread-width of the trigger or first material, e.g., granular material 106. For instance, if the trigger or first material is the granular material 106 being spread at a predetermined rate, when the spread-width of the granular material 106 increases by 50%, the synchronized-width material spreader system may automatically increase the spread-width of the liquid material 122 by a predetermined percentage, in this example, 50%, to match the increased spread-width of the granular material 106. Likewise, if the granular material 106 decreases in spread-width by 50%, the synchronized-width material spreader automatically decreases the spread-width of the liquid material 122 by 50%.

A user selectable pre-set ratio selected from a range of ratios may also be maintained. For instance, if the liquid material spread width is selected to be two-thirds (66%) of the granular material spread width, then when the trigger material spread width is changed, either increased or decreased, the spread width of the other, or "slave" material changes to maintain the pre-selected ratio. Also, a sliding scale or trigger/slave distribution arrangement based on a mathematical relationship may be used, e.g., based on certain characteristics of the multiple materials, to compensate for differences in particle sizes, density, liquid viscosity, atomization particle sizes, bounce, etc. Therefore, as the trigger width changes from minimum to maximum, the slave material width, due to above mentioned characteristics may be varied, say, from 40% to 70% of trigger material spread-width. This capability is particularly useful where the trigger material may have one particle size and the slave may have a different particle size or mass, resulting in different roadway bouncing characteristics between the two materials. Such a sliding scale may allow a uniform or non-uniform pattern of deposition on the roadway surface, as desired. This capability may also be advantageously employed when particle weight, particle size, density, liquid viscosity, atomization sizing, etc. behave differently, yielding other than uniform distributions when direct proportioning is utilized.

The operator may thus control, for example, the spread-width of each of the different materials being dispensed onto the road surface by controlling one trigger material or by having the width of the first material automatically changed based on vehicle location. Consequently, the operator need only actuate the width control system for the trigger material, and the operator does not have to separately and independently control the spread-width of the second or additional or nth material unless special circumstances warrant such control as it will automatically follow the trigger in accordance with the preset or preprogrammed proportions. Optionally, the spread of a first trigger material may be initiated remotely. For instance, automated control may be triggered by a stationary signal device adjacent to, in or on the roadway as part of an Intelligent Transportation System (ITS). Additionally, by use of Geographic Information System (GIS) data in conjunction with Global Positioning System (GPS) data, the precise vehicle location may be automatically determined and automated control initiated. Other methods for controlling application and/or coordinating a change in the width of one material with a like or predetermined (such as for scaling or ratios) change in the width of a second or nth material are further described in U.S. Pat. No. 5,904,296.

Figure 2:
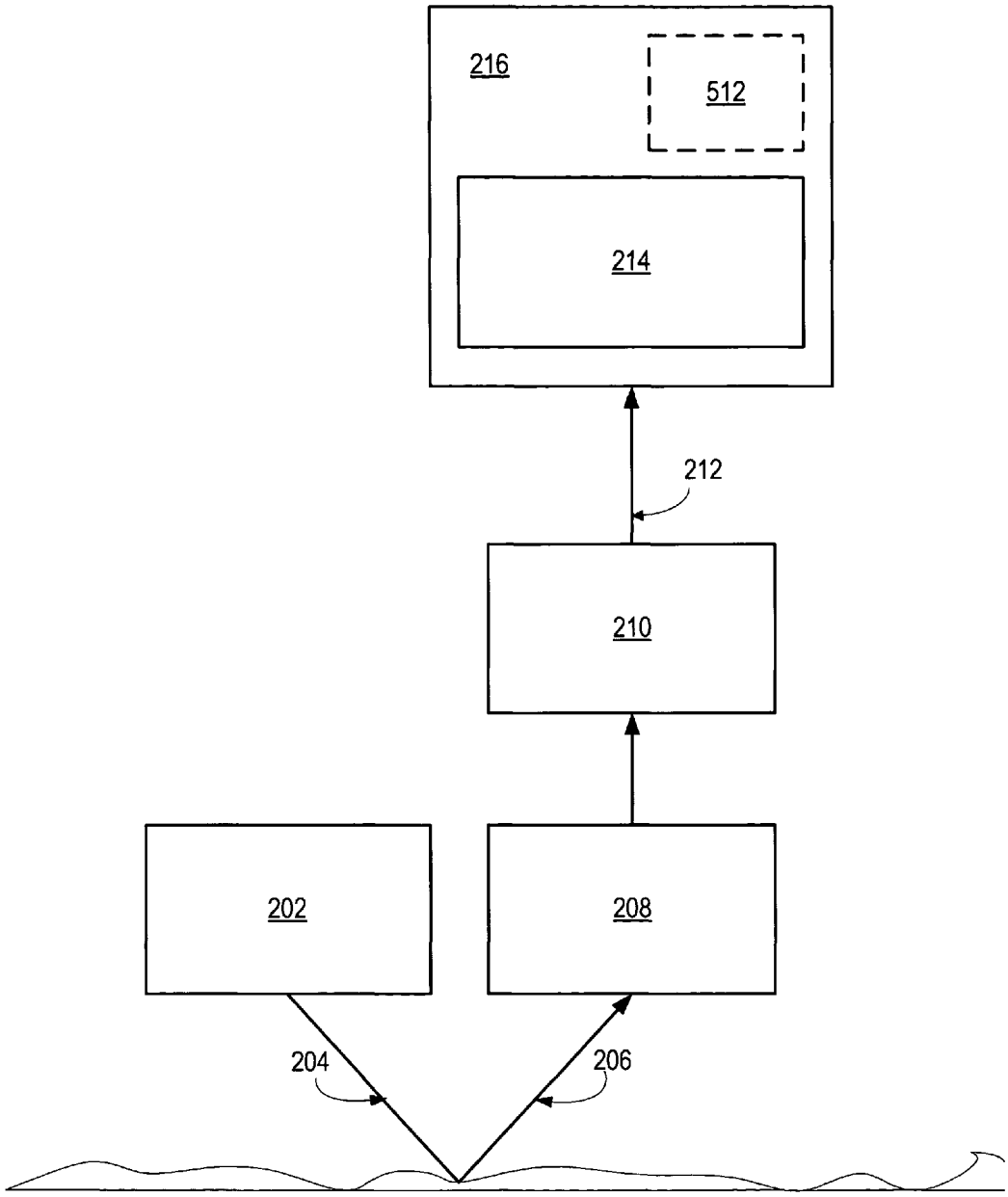
FIG. 2 is a block diagram representing an embodiment of a surface condition sensing and treatment system.

FIG. 2 is a block diagram representing an embodiment of the surface condition sensing and treatment system 200, as may be utilized with the embodiment of FIGS. 1A-1B or elsewhere. System 200 may include a single sensor or a combination of several sensors to detect particular parameters of interest.

Vehicle surface conditions, for example road conditions, may be affected by changes in temperature and material concentrations. Therefore, system 200 may include a variety of sensors, for example, resistance temperature detectors, thermocouple, infrared temperature sensors, conductivity detectors, close proximity electromagnetic radiation (EMR) transmitters and detectors or transceivers, friction measurement devices, and other material analysis systems such as a spectrographic analysis system (e.g., a mass spectrometer). In the latter case, the mass spectrometer or other material analysis device may for example mount inside the vehicle, and a sample conveyor such as a belt or pump line may be used to direct the sample from a flap or other collection platform into an analysis device, e.g., the vaporizing chamber for a spectrometer. Alternatively, an ultra wide band Doppler radar or any other suitable electromagnetic radiation (EMR) emission and detection technique as well as Laser Induced Breakdown Spectroscopy (LIBS) may be used to remotely ascertain chemical and physical characteristics of the material on the roadway surface. As another alternative, several of the above sensing devices may be directed toward materials still on the travel surface, on a moving belt, moving past a sensor, or flying through the air. Such a belt system, and platforms or flaps for mounting the chosen sensors to a vehicle are for example described in U.S. Pat. Nos. 5,619,193 and 6,535,141. A platform similar to those described in the noted references may also be used for mounting an environmental sensors with vehicle 102, as further described herein below with respect to FIGS. 9A-F.

In the embodiment of FIG. 2, the sensor includes a transmitter, such as an EMR transmitter, and a receiver. Transmitter 202 and receiver 208 may be housed together (e.g., as a single unit as a transceiver) or separately and, for example, mounted with a vehicle, e.g., vehicle 102. Transmitter 202 emits one or more beams or signals 204 toward surface material 220 disposed on a vehicle travel surface 222. Vehicle travel surface may be a road, a runway or an agricultural surface. Signals 204 are reflected off the surface material 220 as reflected signals or beams 206 and received by receiver 208. Receiver 208 communicatively connects to a signal processor 210, which processes the reflected signals 206 (or data indicative of such signals) to produce an output or display signal 212 corresponding to one or more conditions or characteristics of surface material 220. Such characteristics include but are not limited to: depth, density, temperature, freezing point, friction and composition of the surface material, including the amount of components or chemicals and/or the percent composition of components or chemicals in the surface material. Components or chemicals in the surface material may also include ice and/or snow, such that output or display signal 212 may correspond to the amount or percent of ice or snow present in the surface material.

Signal processor 210 may include a microprocessor for converting sensed signals to output or display signals 212, and may additionally determine material identity and pertinent material characteristics by comparing received signals with stored potential material data. One or both of processor 210 and display 214 may be mounted on an exterior or in an interior of a vehicle; optionally one or both of processor 210 and display 214 are positioned in a remote location such as a control center.

Display 214 displays information indicative of output signal 212. Display 214 may be a panel with indicators of sensed characteristics of the surface material such as the freezing point, and indicators of the ambient temperature. Display 214 may include connections to more detailed signal analysis equipment such as chart recorders, tape recording devices, or other processing equipment. The display may also include alarms and inputs to automatic functions such as activating anti-lock brake systems, or transfers from two wheel to all-wheel drive systems, or activating chemical spreader control functions (for example, as in FIGS. 3A-C), etc. Alarms may be manually or automatically set, for example according to sensed data such as a freeze point indication or according to a parameter of the measured surface material and/or conditioning materials. In one embodiment, the surface condition sensing and treatment system provides a reliable display of information to the vehicle operator of actual and pending conditions of the road surface.

Display 214 may be a display of a local computer 216, or a remote computer 218, described in further detail with respect to FIGS. 6-8B, below, in which case further processing of output signal 212 may be performed to identify characteristics of the surface material and/or treatment options. For example, the local or remote computer 216, 218 may include a database 512 containing information representing various characteristic values for potential deposited material, surface treatment options and action categories to adjust the application of treatments to the road based on sensed characteristics.

Sensing may be automatically initiated by local or remote computer 216, 218, or manually initiated by an operator of vehicle 102 or a user at a remote station 218. Sensing may likewise be locally or remotely and automatically or manually controlled. Treatments may be automatically selected (i.e., by computer 216 or 218) in response to sensed conditions, or an operator of the vehicle may select a desired treatment, for example, from a list of recommended surface treatments generated by local or remote computer 216, 218. A selected treatment may be automatically or manually applied, initiated either at local computer 216 or remote station 218. Selection and application may be modified at computer 216 or remote station 218, automatically or manually, according to environmental factors, including existing or approaching weather conditions, location of the vehicle and desired surface conditions. Where manual treatment is desired, the system may include a control box for use in manual control and/or monitoring of the material or materials being dispensed from the vehicle.

Figure 3A:
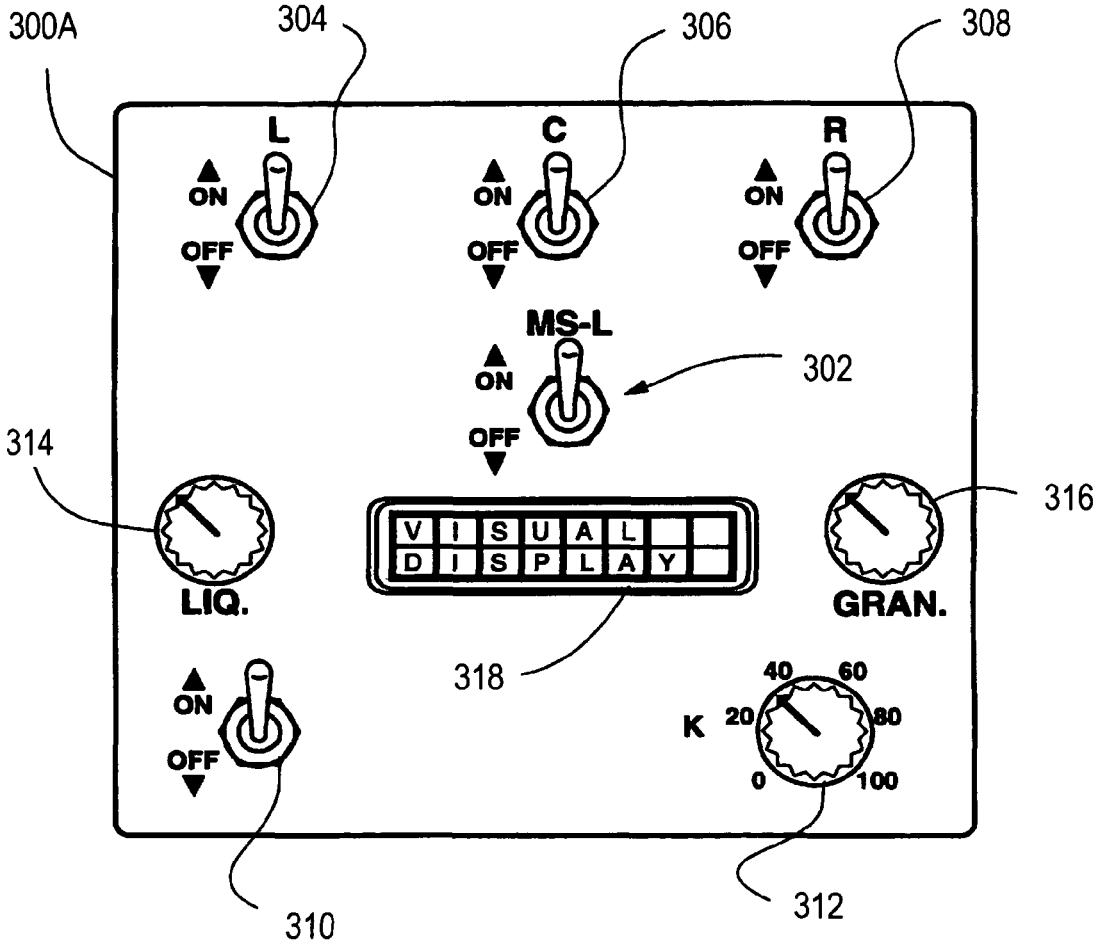
FIGS. 3A-3C show embodiments of a control box operable with the surface condition sensing and treatment system of FIG. 2.
Figure 3B:
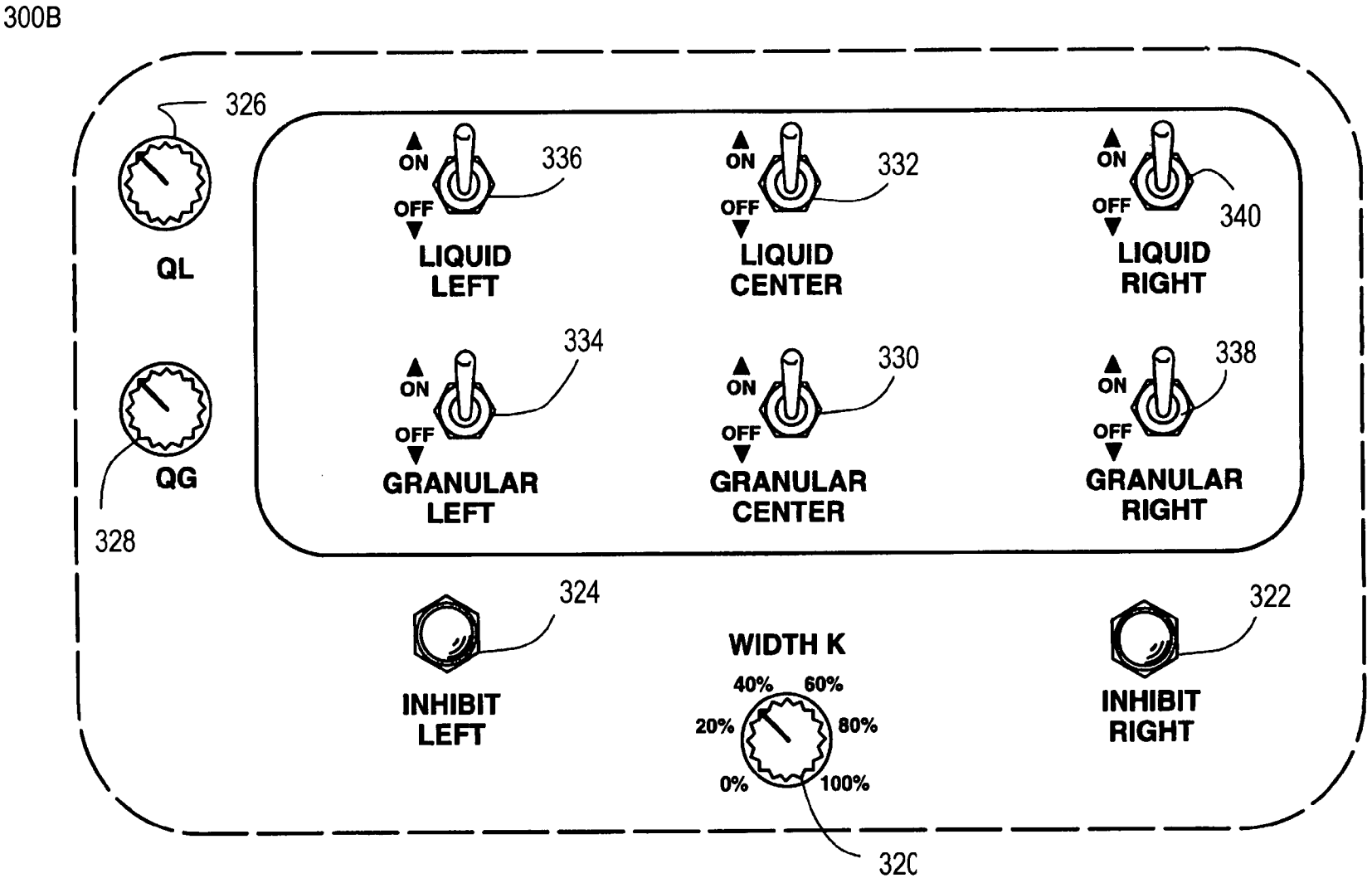
Figure 3C:
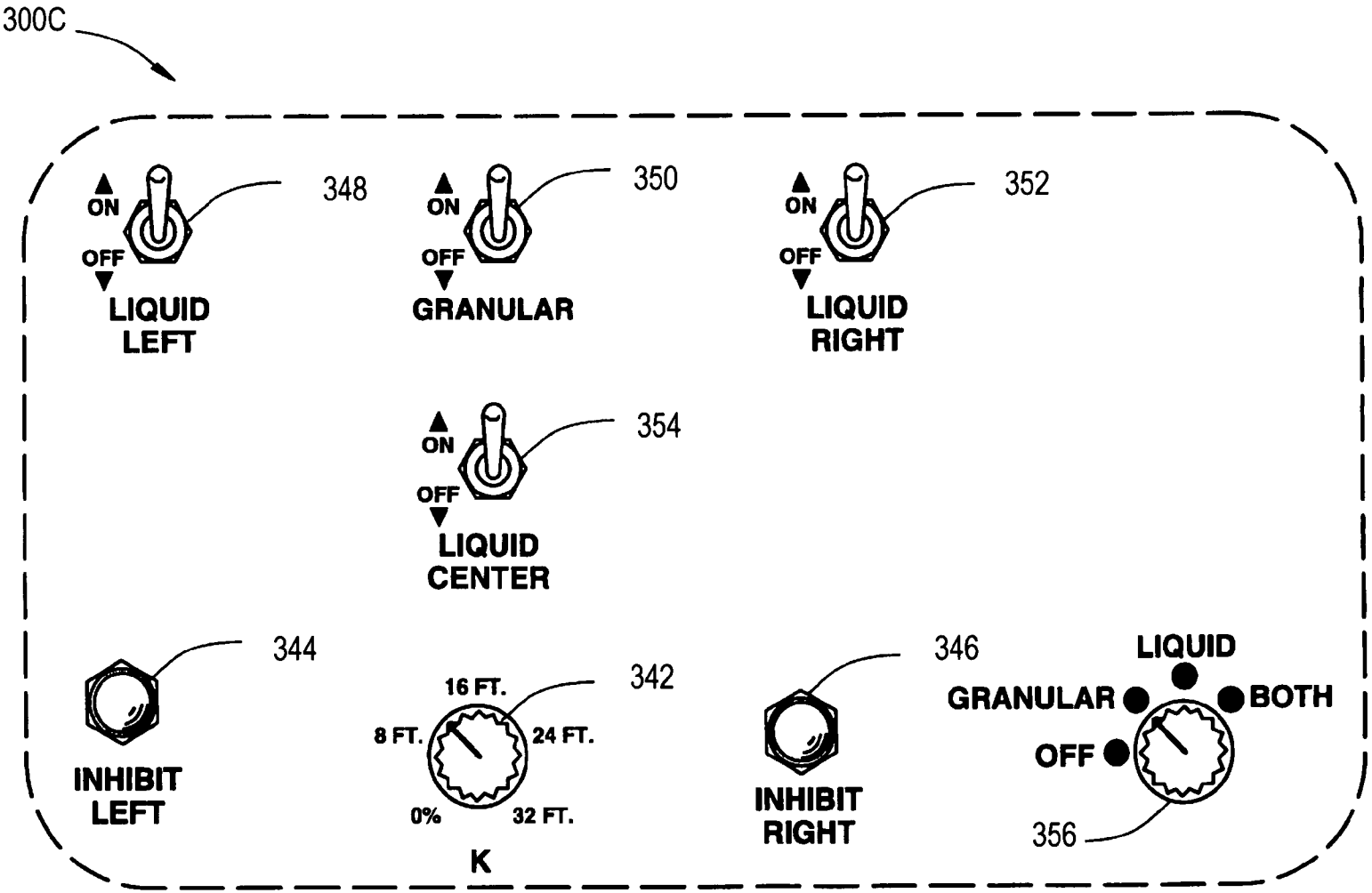

FIGS. 3A-3C depict a control box 300A for use with an embodiment of system 200 of FIG. 2, for example when mounted with conditioning vehicle 102 and material distribution system 104 shown in FIG. 1B. Control box 300 may be positioned adjacent an operator in vehicle 102 or integrated into the dashboard of vehicle 102, and may be used by the operator to simply control the material or materials being dispensed from the vehicle, either manually or automatically. Alternatively, control box 300 may be located at a position remote from the driver, or even the vehicle 102, and may be controlled by a third party or controller device, thus requiring the driver to simply drive, while a third party or remote computer controls material distribution system 104 via a slave unit mounted in the vehicle.

The embodiments shown in FIGS. 1A and 1B contemplate controlling two materials, a granular material 106 and a liquid material 122, with the granular and liquid dispensing systems being analogous to those previously explained and described above. The same or a similar system, as described herein, may also be used to control a single granular or liquid material or more than two materials, whether they be liquids or granular materials and in any combination. The control box 300A in the embodiment shown in FIG. 3A contains a plurality of toggle switches 302, 304, 306, 308 and 310, as well as a plurality of fine-adjustment knobs 312, 314, and 316, each having a specific use. Master switch 302 serves as a master switch for the liquid spreading system. When the master switch 302 for the liquid spreading system is turned on, the liquid material control switches 304, 306 and 308 are enabled and may be operated. The toggle switch 304 may be an on/off actuation switch device for controlling the liquid flowing through the left end 126 of the liquid spray bar 120, which may be controlled by an associated left valve (not shown). Once activated, the valve may be proportionately controlled by the control box 300A, as described further below. On/off switch 306 may be a toggle switch similar to switch 304, but used instead to actuate the flow of liquid material through the center portion 124 of the liquid spray bar 120. Switch 306 may also control a center liquid valve (not shown) in the liquid dispensation system. Once activated, the valve may be proportionately controlled by the control box 300A. The switch 306 may be an on/off toggle switch for actuating the flow of liquid through the right portion 128 of the liquid spray bar 120, and may control a right liquid valve (not shown). Once activated, the valve may be proportionately controlled by the control box 300A. The position of the knob 312 controls the speed of rotation of the disk 108 which spreads the granular material 106 and may be graduated between zero and 100% dry material spread-width. The control knob 314 controls the rate of flow of liquid through the liquid dispensing system (for instance, in gallons per lane mile). The control knob 316 controls the rate of granular material being dispensed through the granular dispensing system (for instance pounds of material per lane mile). The ON/OFF master switch 310 controls the on/off status of the entire spreader system. The visual display screen 318 may be used to indicate to the operator what the settings are.

In using the first embodiment of the control box 300A as disclosed in FIG. 3A, the granular material 106 may serve as a trigger material from which the system triggers a liquid spread-width. The operator first turns on the spreader system by toggling the ON/OFF master switch 310 to ON. The operator then sets the rate of granular disbursement and the rate of liquid disbursement using the appropriate control knobs 314, 316, respectively. At this point, the operator is only engaging the dispensing system for dispensation of liquid material to the road surface. The switches 304, 306 and 308 are appropriately activated by the operator as desired. As shown in FIG. 3A, all three switches are in the ON position. This results in liquid 122 being dispensed from the entire spray bar 120 through the left, center and right portions.

In operation, where the first embodiment of the control box 300A shown in FIG. 3*a* is used, and the granular material 106 is considered as the trigger material off of which the spread width of a slave liquid material 122 may be controlled, the operator modifies the width of the granular spread by adjusting the K control knob 312. Adjusting the K control knob 312 causes a signal to be sent through the electrical lines, for example to a disk valve (not shown) to allow more hydraulic fluid to flow through a motor for the spreader disk 108. Adjusting the granular knob 316 in turn causes a signal to be sent through the electrical lines, for example to a valve for auger 112, and allows more or less hydraulic fluid to flow through a motor 142 for the auger 112, thus changing the rate at which the granular material is fed to the spreader disk 108. This in turn changes the speed at which the disk 108 spins, thus changing granular spread width. As discussed, the change in granular width using the K control knob 312 may be sensed and cause a change in liquid spray width. Hydraulic fluid, liquid material and electrical control systems are also further described in U.S. Pat. No. 5,904,296.

Control knob 312 is shown positioned at approximately 30% of the maximum disk speed, to control the granular material 106 spread-width. In this situation, both granular 106 and some liquid 122 material (which may serve as a pre-wetting liquid) are spread by the spreader disk 108, and liquid material 122 is spread by the spray bar 120. In the event that K control knob 312 is rotated to 75% of maximum granular spread-width, software internal to the control box 300A controls the increase in disk 108 spinning speed, causing the granular material 106 to be spread to a greater width. Software internal to Box 300 may simultaneously sense the selected increase in the granular spread-width and accordingly send sufficient liquid material 122 to the center, left and right spray bar portions 124, 126 and 128 to match the new width of the granular material 106 being disbursed by the spreader disk 108.

The nozzles 130 in the spray bar 120 may also be adjusted accordingly by the software controller, to appropriately adjust their spread-widths. The operator may also shut down the left, right or center portions 126, 128, 124 of spray bar 120 and keep them from dispensing liquid 122 there through by manually operating toggle switches 304, 306 or 308, respectively. This would be effective for temporarily turning off, for instance, the liquid disbursement from the left spray bar portion 126 to allow an oncoming vehicle to pass vehicle 102. In this example, if the liquid was the trigger material, this action would also typically automatically adjust the width of the nth material.

Turning now to FIG. 3B, with the granular material 106 as the trigger material, a second embodiment of the control box 300B is disclosed. The control knob 320 controls the width of spread of any and all materials which are enabled. The Inhibit Right control knob 322 may inhibit any enabled material from being spread to the right side of the carrier regardless of the spread-width selected on control knob 320. Likewise, the Inhibit Left control knob 324 may inhibit any enabled material from being spread to the left side of the carrier, regardless of the spread-width selected on control knob 320. Control knob 326 controls the rate of liquid disbursement through spray bar 120 to the vehicle travel surface 322 (for instance, gallons per lane mile). Control knob 328 controls the rate of granular material 106 disbursement to vehicle travel surface 322 (for instance, pounds per lane mile). Granular and the liquid material dispensing means (e.g., one or more spinning disks 108 and spray bar 120) are controlled by each appropriate switch: center 330, 332; left 334, 336; and right 338, 340 on the control box 300. These switches allow the operator to selectively turn the spread of material in any of these regions on and off, as desired.

Turning now to FIG. 3C, a third embodiment of control box 300C is disclosed. The third embodiment of the control box includes a control knob 342 which controls the width of spread of any enabled materials, an Inhibit Left control knob 344, an Inhibit Right control knob 346, a left 348, center 350 and right 352 liquid on/off toggle switch, and a single granular on/off toggle switch 354. A master control switch 356 allows the operator to configure the dispensing system for granular material spreading only (e.g., via spinning disk 108), liquid material spreading only (e.g., via spray bar 120), or a combination of granular and liquid material spreading.

Figure 4A:
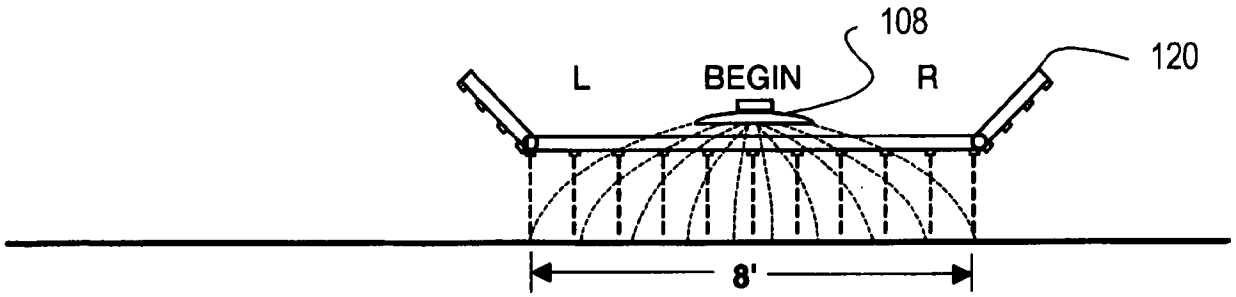
FIGS. 4A-4C schematically represent an increase in width of material spread as provided by an embodiment of a surface condition sensing and treatment system.
Figure 4B:
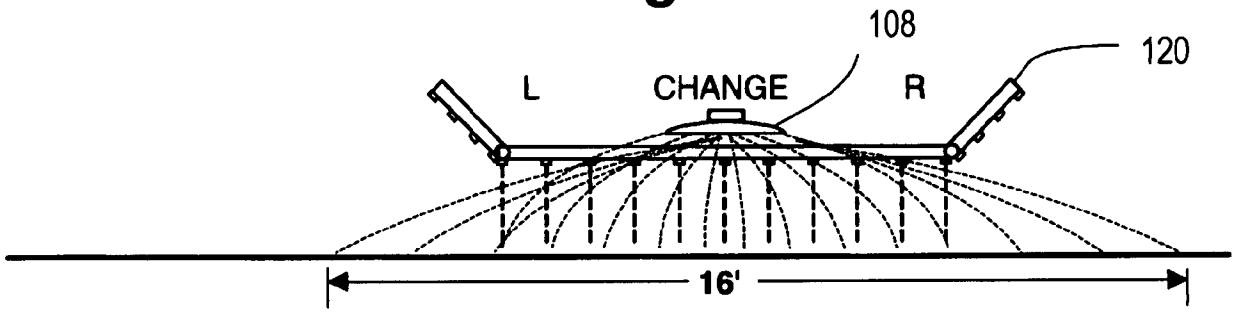
Figure 4C:
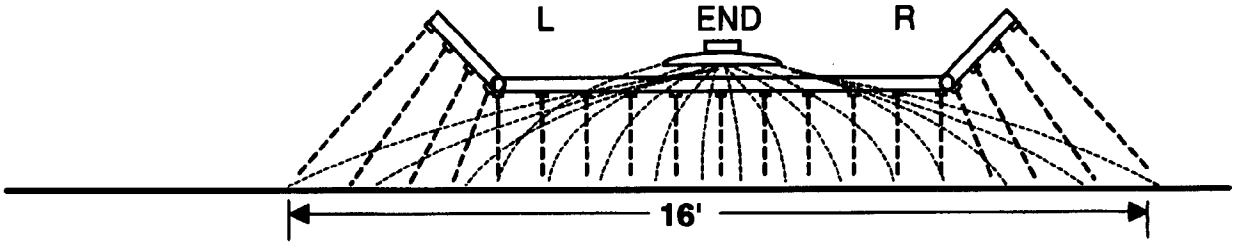
Figure 4D:
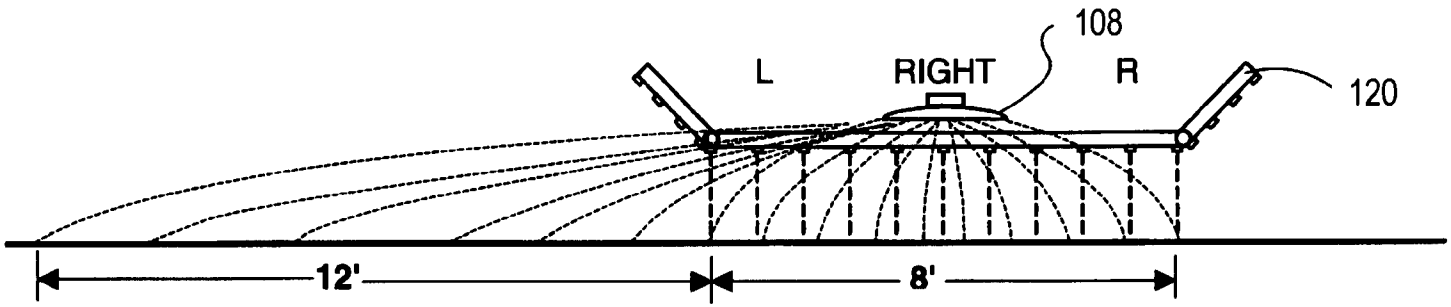
FIGS. 4D-4F schematically represent a decrease in width of material spread as provided by an embodiment of a surface condition sensing and treatment system.
Figure 4E:
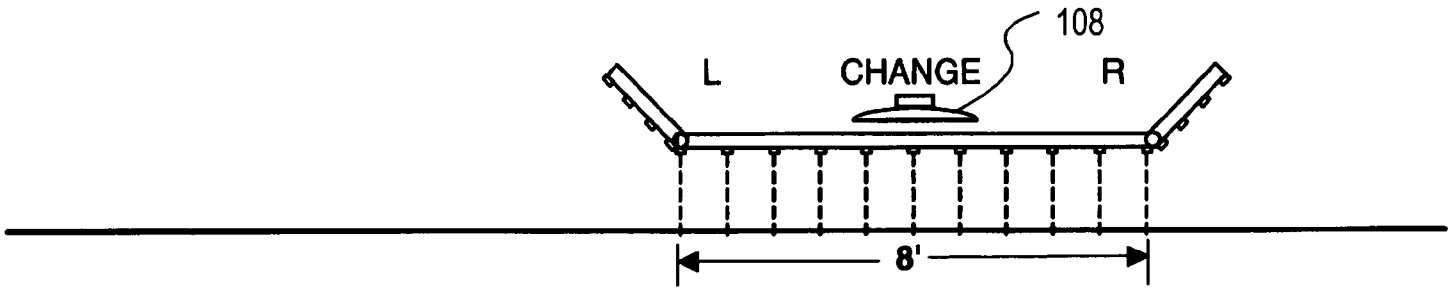
Figure 4F:
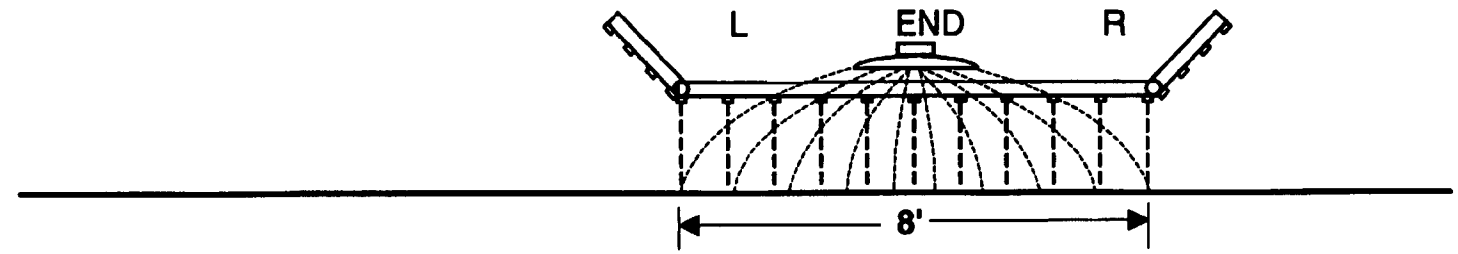

FIGS. 4A-4C schematically represent an increase in width of material spread as may be selected with an embodiment of a surface condition sensing and treatment system. As an example of one general operation, FIGS. 4A-4C disclose an increase in the spread-width of the liquid disbursement triggered by the increase of the granular spread-width, for example, in response to information provided by sensors of the surface condition sensing and treatment system. In this example, the surface condition sensing and treatment system, i.e., as shown in FIG. 2, operates with a synchronized-width material spreader. In one example, liquid spread-width may be selected to automatically control the width of the granular spread-width, at control box 300A-C. In FIG. 4A, granular material 106 is shown as being spread to a width of approximately eight feet by the spreader disk 108, and liquid material 122 is shown as being spread to a width of approximately eight feet by the center portion 124 of the liquid spray bar 120.

In FIG. 4B the operator increases the granular material spread-width to 16 feet by appropriately modifying the K control knob 312 setting, for instance, in the first embodiment of the control box 300A. The surface condition sensing and treatment system, through the various sensing means employed therein, senses the increase in the spread-width of the granular material 106, and automatically increases the spread-width of the liquid material 122 through the spray bar 120 portions, in this instance by actuating the left 126 and right 128 portions of the liquid spray bar 120, which causes the liquid spread-width to match the granular spread-width (FIG. 4C).

In FIGS. 4 D-F, an embodiment of the surface condition sensing and treatment system provides for decreasing the spread-width of the granular material 106, as triggered by the decrease in spread-width of the liquid material 122. In FIG. 4C the spread-width of both the granular and liquid material 106, 122 is set at approximately 20 feet. The operator then actuates the control of the liquid disbursement to reduce the liquid spread-width to approximately eight feet without use of the side extension nozzles 130 as shown in FIG. 4E. (FIG. 4E is shown without granular material distribution, for clarity). Spread width of the granular material 106 may be automatically or manually reduced, for instance by reducing the spin speed of spreader disk 108 (FIG. 4F), according to information provided by various sensors of the surface condition sensing and treatment system (see, for example, the description of FIG. 6, below).

The width and direction of material spread off of a spinning disk such as spreader disk 108 may be controlled by the point of impact of the granular material 106 as it strikes the disk 108. As is known, if the disk 108 is moved with respect to dispensing chute 114, or if chute 114 is moved with respect to the spinning disk 108 so that the impact point is changed radially and/or circumferentially around disk 108, the desired flow width and direction of granular or liquid material may be controlled.

Figure 5:
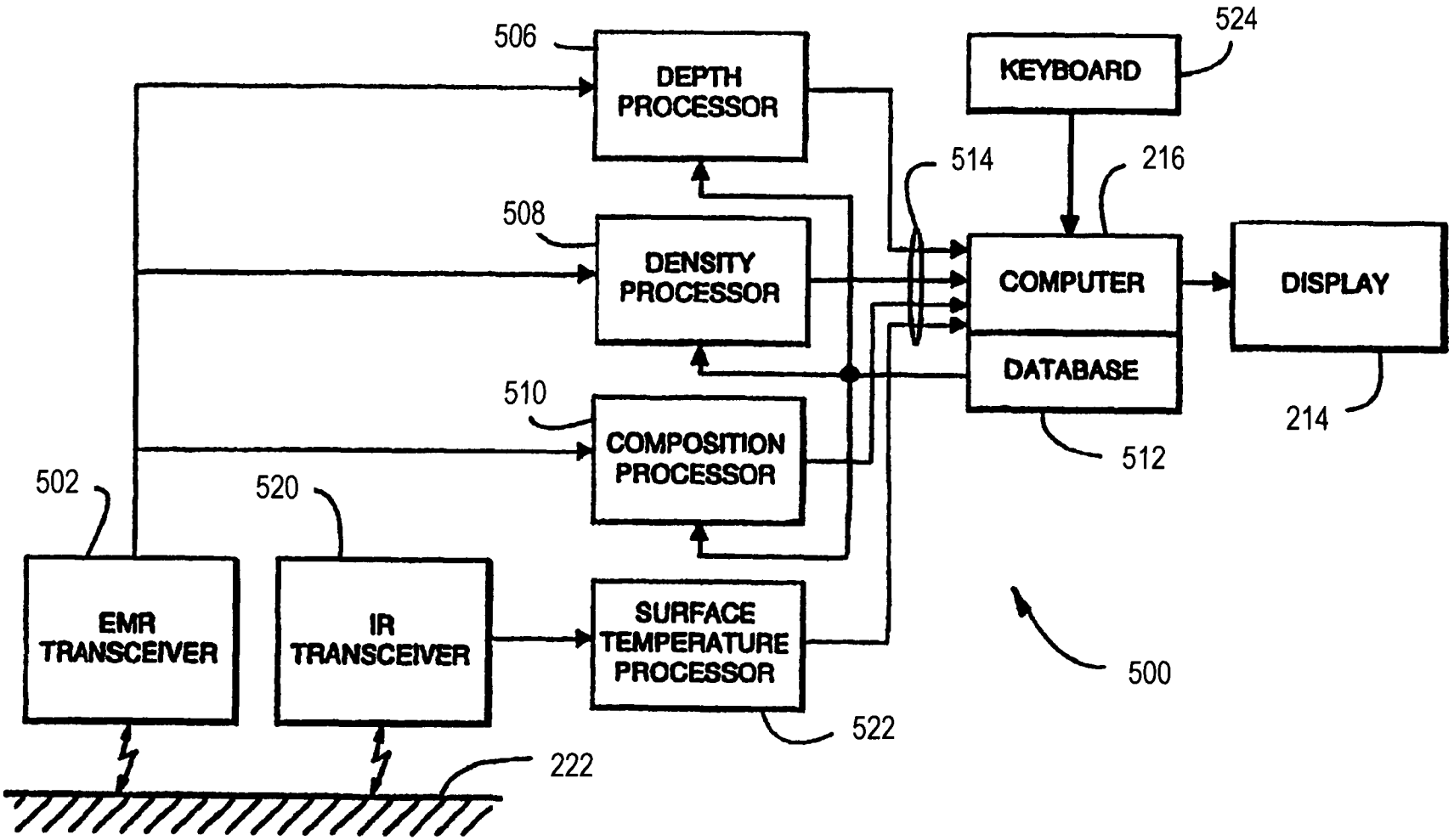
FIG. 5 is a block diagram representing an embodiment of a surface condition sensing and treatment system providing real-time surface condition information to a vehicle operator and to an on board computer
Figure 6:
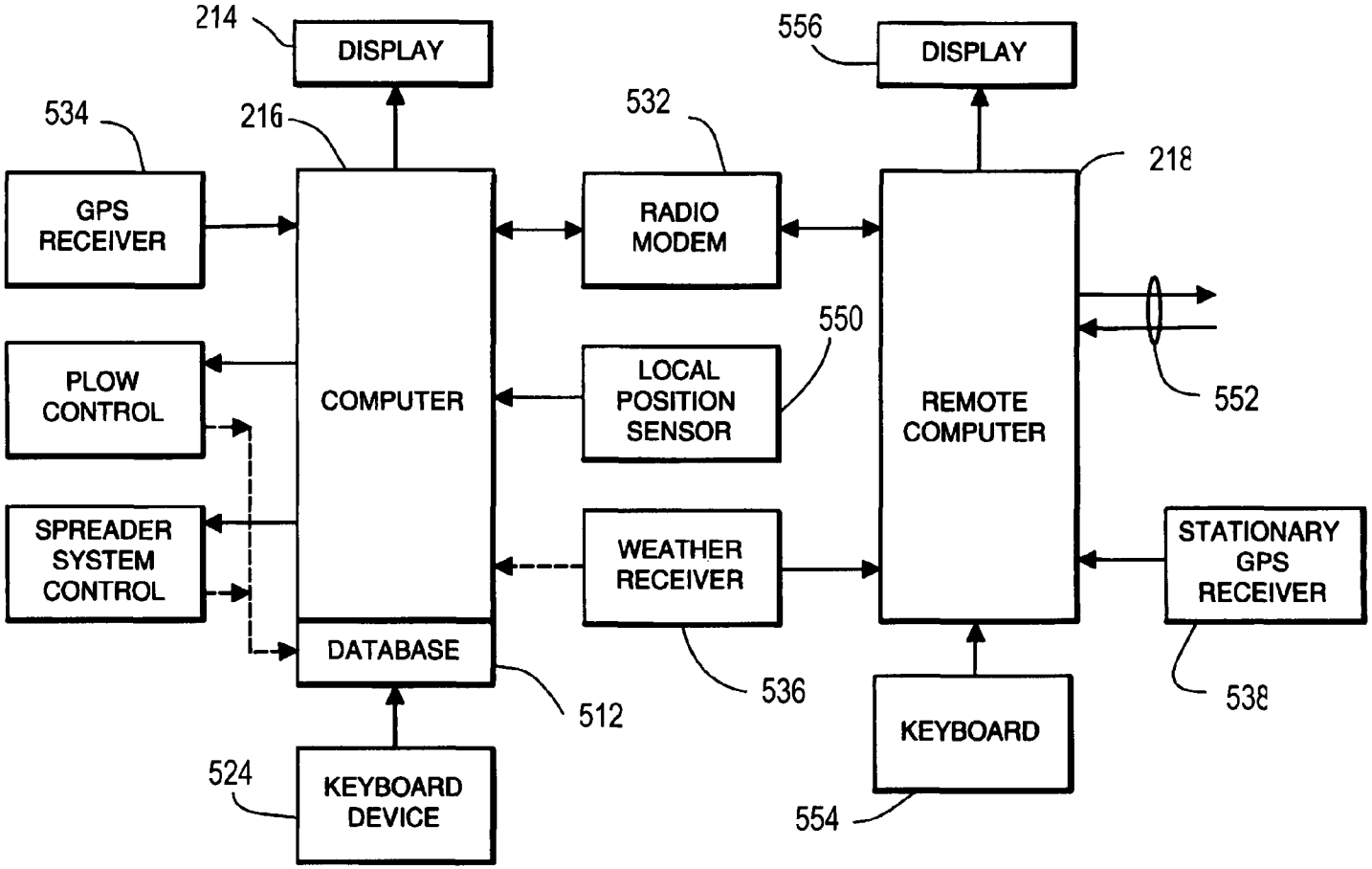
FIG. 6 is a block diagram showing automatic control features of a surface condition sensing and treatment system.

FIG. 5 is a block diagram representing an embodiment of a surface condition sensing and treatment system providing real-time surface condition information, e.g., to a vehicle operator and to an on board computer. In an embodiment depicted in FIG. 5, real-time surface condition information, for example, characteristics of the surface material and/or width of the vehicle travel surface, may be provided to a vehicle operator and/or an on board computer 216 utilized to automatically control the spread of conditioning materials (e.g., one or more granular materials 106 and/or liquid materials 122) on the vehicle travel surface 222. In an embodiment, automatic surface condition sensing and treatment system 500 is mounted on the vehicle 102. Control and remote component connections to the local sensing portion of system 500 are shown in FIG. 6. The sensing portion of the system 500 includes at least one electromagnetic radiation transceiver 502 which emits a ultra-wide band (UWB) impulse radar. One or more short electromagnetic (EMR) pulses (such as signal 204) may be propagated from transceiver 502 and echoes (such as signal 206) that reflect from the road surface 222 and from surface material 220 may be evaluated. These reflected signals may be sent to a processor such as processor 210 (FIG. 2) or, as shown in FIG. 5, the signals may be sent to a separate depth processor 506, density processor 508, and/or a chemical composition processor 510. A friction processor 505 may also be utilized to determine a coefficient of friction from the reflected signal. Optionally, an alternate friction measurement device may be employed alone or with the friction processor 505, to determine a coefficient of friction of the surface material. It is to be understood and appreciated that multiple single-characteristic processors may be used, or optionally, one or more processors with multiple processing capabilities may be utilized.

The EMR reflected pulse may be utilized directly by the depth processor 506 to determine the depth of any layer of surface material 220 on the travel surface 222. However, the friction processor 405, density processor 508 and composition processor 510 may also rely on input from a database 512 to determine, by comparison to peak height or phase shift of the reflected signal versus the incident signal, an output which is unique to a particular chemical composition, density or coefficient of friction. Comparing these outputs to the database content produces or may result in quantitative friction, density and composition information 514 (such as an amount or percentage of ice in the surface material), which is, in turn, fed to computer 216 along with depth information 515. This information may in turn be utilized by the computer 216 in conjunction with the database 512 to determine the freeze point temperature of the particular composition of the material on the vehicle travel surface. The freeze point determination result is then processed along with the depth 506 information in the computer 216 to provide information necessary to determine what additional chemicals, both type and amount, need to be deposited on the road surface in order to minimize hazardous conditions. These results may be provided on the display 214. In addition, the computer 216 may provide a direct output to a control device for automatically dispensing the appropriate amounts of chemicals to the road surface as the vehicle 102 drives along.

A temperature sensor such as an infrared transceiver 502 may also be used, e.g., mounted on the vehicle and directed toward the road surface. The transceiver 502 provides an output to a road temperature processor 522 which in turn also feeds an output to the computer 216 indicative of the actual surface temperature of the road or, if covering material such as snow or water are present, the actual temperature of the material on the road surface.

System 500 may be compactly designed for unitary installation in the cab of a road maintenance vehicle, such as a salt truck, with the display 214 and any input device such as a voice recognition device or keyboard 524 integrated into the dashboard of the vehicle. The driver may then input to the computer 216 desired deicing concentrations or other desired input information. This inputting may also be triggered automatically or by a third party from a location remote from the vehicle or by the vehicle arriving at a predetermined location, as evidenced by GPS/GIS coordinate data under software control. The computer 216 may then compare the actual composition and status of the surface material 220 actually on the vehicle travel surface 222 and either display or automatically control the dispensing of additional chemicals to vehicle travel surface 222. The temperature sensor, such as an infrared transceiver 502 described above, for example measures temperature of whatever material is on the surface, and need not measure the temperature of vehicle travel surface 222 (but might in particular if the surface is dry). Consequently, system 500 may also include a travel surface temperature sensor and/or a subsurface temperature sensor 528 connected to a surface and subsurface temperature processor 522 which, in turn, provides a surface and/or a subsurface temperature signal to the computer 216. The surface/subsurface sensor 528 may be a short range ground penetrating radar transceiver unit calibrated for determining road surface temperature/subsurface temperature at a depth of about 12-18 inches. This subsurface temperature information may then be used by the computer 216 to estimate the heat capacity of the road bed and thus predict the rate of change of surface temperature for a given atmospheric set of conditions plus calculate application rates for various surface conditioning materials, in particular, those materials which may be readily available on the vehicle or available on a different vehicle which may be expeditiously rerouted to the appropriate location.

As is shown in FIG. 6, computer 216 of system 500 may also be connected through a communication interface device such as a radio modem 532 to the remote computer/processor station 218. The system may include an on board Global Positioning System (GPS) receiver or a Differential Global Positioning System (DGPS) receiver 534 which provides accurate spatial position information for the vehicle 102 to the computer 216. The database 512 may include a Geographical Information System (GIS) format database for the region in which the vehicle 102 is operated, for example. Together with the GPS coordinate information from the receiver 534 and the GIS database information in the database 512, the computer 216 may constantly track the vehicle's position and store sensed current road conditions, as described above, in the database 512. The computer 216 then compares the position with historical weather conditions and road surface conditions that have occurred at the vehicle's location, which are stored in GIS format in the database 512. This position and past and current road condition information may then be compared with near-term weather information relayed by the remote station 218, or provided directly by an on-board weather data receiver 536, and balanced against the preprogrammed or predetermined desired requirements for the vehicle's location. The resulting difference information may then be translated to compensatory surface application composition and distribution commands fed to the material distribution system 104. For example, treatment chemicals may be automatically determined by the computer from a database of predetermined criteria for that location or calculated based on current or predicted weather conditions, sensed surface material or road surface conditions, and the desired road surface conditions. An amount of treatment material necessary to minimize the development of adverse conditions may likewise be calculated based upon these factors. The information may continually update based on the most recent data as the vehicle 102 travels along its route. The computer 216 also provides a running historical data input to the database 512 to track chemical application data at the particular location, whether the application be manual or automatically accomplished. In other words, database 512 may include predetermined criteria for a particular location, GIS information for the region in which the vehicle 40 is being operated, and historical and parametric data to determine real time potential for road surface material reaching the freeze point due to the effects of, among others, wind chill, moisture type and moisture content, chemical composition, surface and subsurface temperature, moisture accumulation and past treatment activities. For example, some areas may have historically required a greater or lesser amount of treatment than would be otherwise be indicated, in order to achieve a desired road condition.

The computer and database may then be utilized to determine optimum amounts of available conditioning materials present on the vehicle 102 and needed on the surface to achieve the desired results (e.g., achieve a desired level of service), or subsequently available via another vehicle, to apply to the vehicle travel surface depending on sensed actual road conditions, local weather, and historical experience data. Actual and pending road conditions, actual and pending weather conditions and recommendations may be displayed to the vehicle operator or an operator at remote computer 218 such that the appropriate action may be manually initiated, or optionally, treatment material may be automatically applied with or without displaying recommendations. It is to be understood that automatic treatment may be initiated locally or remotely, by remote station/computer 218.

The remote station 218 may be a stationary command/control station or may actually be one or more mobile stations, for example mounted upon a vehicle 102, connected via communication links in a network of other similar computers mounted in other service vehicles. The remote station 218, if stationary, may include a DGPS receiver 538 to provide reference GPS data signals to the computer 216 for very accurate DGPS position determinations. In addition, weather conditions may be measured and/or received at vehicle locations and future travel surface conditions may be predicted and forecast to provide recommendations for and verification of surface conditioning activities and results. For example, the remote station 218 and/or computer 216 may receive weather forecast data received from other sources such as the National Weather Service or private forecasting service via receiver 536. This forecast information may be correlated and translated to the particular positional coordinates of the vehicle 102 in order to predict near term weather conditions and transmit this information to the computer 216 and also predict near term trouble spots in other locations. The computer 216 or remote computer 218 may then use this weather information in conjunction with a database or lookup table of action categories to adjust the application of chemicals to the road based on the current or predicted impending conditions in addition to application adjustments for actual real time road conditions as above described. The weather information may also be used to alert other vehicles and locations as to adverse conditions. The computer 216 may provide control functions which include automated control of the material distribution system 104 as has been described with reference to FIGS. 1A-3C above except that the proportioning controls may be automatically implemented rather than relying on the operator to manipulate knobs and switches; however, optionally, the operator may retain control if so desired.

The remote computer 218 may be connected to other sources of data such as other computers, via a data transfer device 552. Also, to provide local input, a keyboard 554, or other input device such as a voice recognition device, may be connected to remote computer 218. Similarly, a display 556 may be provided for the operator of the remote computer 218.

In addition, the global positioning system (GPS) receiver signal may be used as an input to the automatic control of material type, spread width, spread rate, quantity or direction. For example as described with respect to FIGS. 1A-1B, above, as well as for adjusting various material types and amounts, etc. being applied through the use of the control system. For instance, if the course on which the vehicle 102 is traveling has been determined and mapped in GIS format and stored in a computer database, i.e., database 512, for the optimal spread widths and material proportionality at different geographical features or locations (such as, without limitation, bridges and locations of differing road widths), then the control system may be triggered by the real-time GPS readings to adjust the spread width to the known optimal dimensions, deposit desired material types and amounts, etc at the appropriate locations.

Computer 216 or remote computer 218 may automatically control other aspects of operation of a surface conditioning vehicle 102. For example, briefly, a snow plow may be provided that has at least one movable side discharge blocking plate which is power operated, either hydraulically, electrically, or pneumatically, to raise the blocking plate to permit side discharge of snow or lowered to prevent discharge of snow as the vehicle 102 passes a feature such as a residential driveway. Since the position of driveways, intersections, lane widths, obstructions, etc. may be included in the database 512 stored in the computer 216, and the GPS receiver 534 may provide accurate position information for the vehicle 102, the computer 216 may be easily programmed to raise or lower the plow or the discharge blocking plates as the vehicle 102 passes a driveway or extend or retract the blade or change its configuration as appropriate for the lane width on a particular stretch of roadway. The plow may also be fitted with at least one extensible blade, which may be pivotally mounted to the plow and automatically rotated to extend the plow path. Alternatively, during a first pass of the vehicle 102 past a driveway, the blade may be manually extended, retracted or pivoted, or blocking plates lowered and raised, and the position information sensed and fed back to the database 512 so that the computer 216 may "learn" or cause these actions to automatically be performed during future passes. U.S. Pat. No. 5,904,296 provides further description of such features.

Position markers, such as a magnetic strip, may be provided along the roadway and a local position sensor 550 such as a magnetic pickup may be mounted on the vehicle 102, to provide local sensing input for the driveway or other obstacle position, in order to trigger movement of blocking plates or changes in the blade width or to reposition the blade to avoid obstacles. These local position markers and corresponding local position sensors 550 may also be used to temporarily change the spreader discharge configuration as a driveway or obstacle is passed, rather than utilizing GPS data. It should be understood that GPS data and GIS data may be combined with use of local markers and local position sensors in a variety of combinations. For example, the use of local position markers and vehicle mounted sensors 550 may be particularly advantageously used during road construction activities to automatically override information provided by the GPS and GIS data. The computer 216 may be programmed to utilize the GPS and GIS data unless superseded by trigger of the local sensor 550 or superseding manual control by the operator.

Further, the computer 216 may be programmed utilizing decision making software techniques to compare the stored historical surface condition data and records of any remedial action previously taken during previous passes at the particular location, with current environmental forecast information, current road surface condition information, and past site specific environmental forecast data in order to predict present and future conditions at the current location. This process may be further enhanced by tracking, on board, the on board material contents and dispensing rates in order to predict when or if the truck 102 or an additional truck should return to the particular location. Material dispensing rate and type of material dispensed at a particular location may be tracked and associated with GIS data. This information may then be relayed to the remote computer 218 or to another vehicle in a network (if computers 216 are so arranged in vehicles of a network) to forecast future service schedules. For example, once a course has been chosen, a local or remote computer 216, 218 may read position information from a GPS receiver of a vehicle, relating this to the GIS data, may adjust the fluid material spread width to the known optimal dimensions and automatically deposit desired material types and amounts at the appropriate locations as the vehicle travels past the location.

In another, more localized application, the computer 216 may compare current road conditions through use of any of the sensing systems disclosed in U.S. Pat. No. 5,619,193 and as shown in FIG. 5 along with on-board monitoring of the spreader capabilities, the materials on hand, the GPS signals and weather information received from the remote computer 218, and may continually provide the operator with direction as to whether to retrace his route to make additional applications to the roadway. This automated system may thus optimize application of granular and liquid conditioning materials throughout an adverse weather pattern or storm and may tailor the application based on past actions and current surface conditions. For example, in spots where unusual winds are encountered or drifting occurs, additional material applications may or may not be required. These areas are generally predictable such that the database 512 may reflect these historical conditions, therefore making the surface condition sensing and treatment system particularly useful in consistently treating road surfaces in an optimum manner.

Actual surface conditions and observations may also be inputted to the computer 216 via the keyboard 524 or other input device in those circumstances that are not predicted or need correction. An example of this situation might be where the traffic patterns at a particular location or along a particular route differ according to time. For example, if the traffic is heavy, as during rush hour, more mixing on the surface of the applied chemicals (and/or the applied chemicals with existing surface materials) takes place and therefore a different application mixture may be more appropriate than the computer-generated amounts and proportions. If the historical data at this location involved non rush hour circumstances, the operator may wish to manually correct the predicted requirements.

Figure 7:
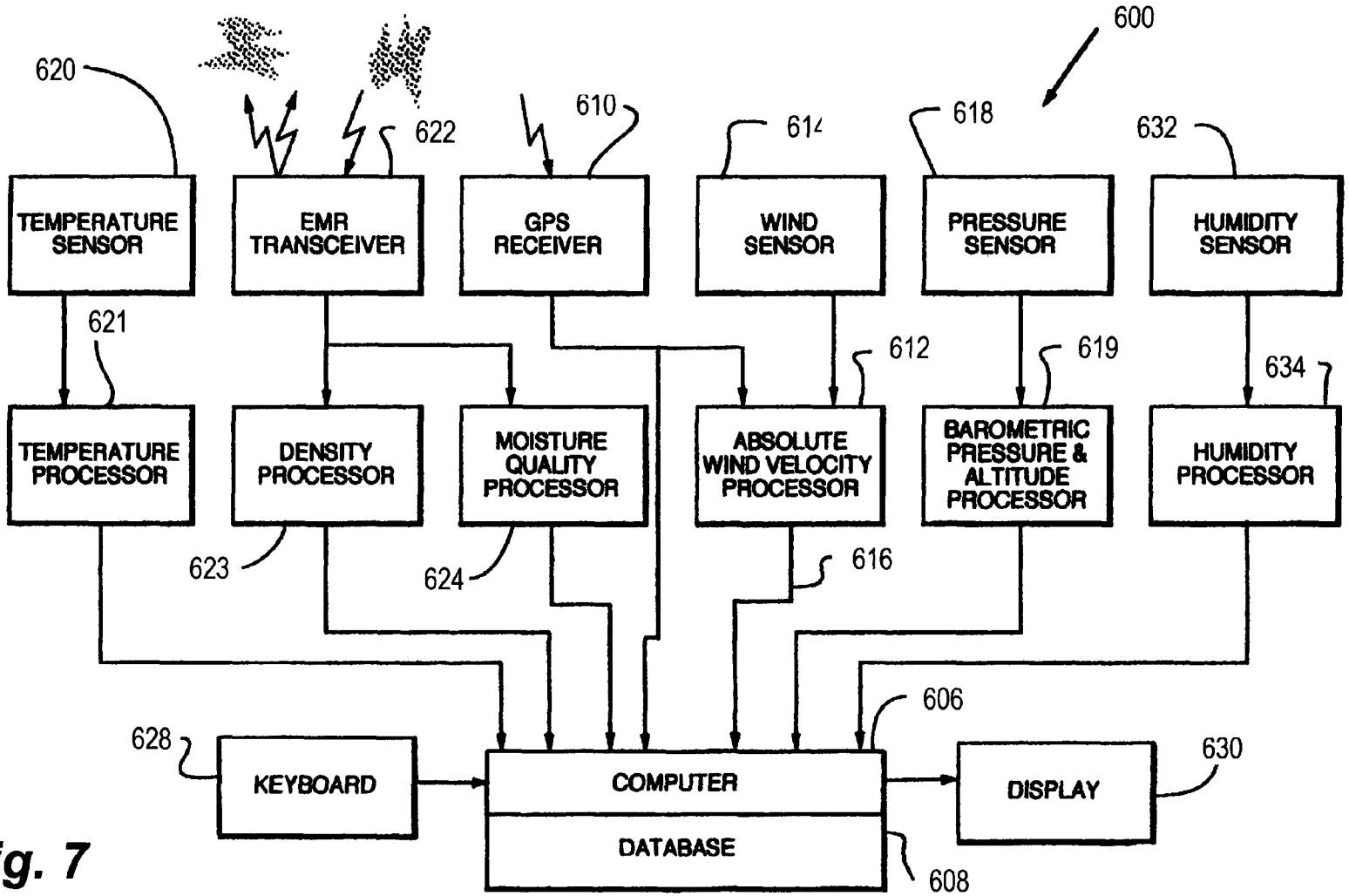
FIG. 7 is a block diagram depicting remote sensing features of a stationary or vehicle-mounted weather monitoring system.

In the embodiment of FIG. 7, a weather monitoring system 600 (which may be part of the surface condition sensing and treatment system (e.g., system 500)) has a Global Positioning System (GPS) receiver 610 mounted in the vehicle 102. The GPS receiver 610 may constantly monitor a plurality of geosynchronous orbiting satellite signals and may receive typically 12 simultaneous position signals to accurately triangulate the vehicle's position at any moment and provide accurate coordinates of the vehicle 102 as well as generate and provide a velocity signal (both speed and direction) to a central computer 606 (e.g., remote computer 218) and to an absolute wind speed and direction processor 612.

The wind speed and direction processor 612 also receives an input from wind speed and direction sensor 614 which is for example mounted in an exterior location on the vehicle 10 such as on the roof of the cab of the vehicle 102. The wind sensor 614 may be any suitable wind speed and direction sensor, however, a Model 425 Ultrasonic Wind Sensor by Handar International of Arlington Va. may be used. This wind sensor 614 uses ultrasound to determine horizontal wind speed and direction based on ultrasonic transit time between three spaced transducers spaced 120° apart. This sensor is described in detail in U.S. Pat. No. 5,343,744. The sensor 614 has both analog and digital outputs.

The wind speed and direction processor 612 may thus convert the vehicular mounted wind sensor output signal to a vector having both magnitude and direction, and then subtracts the vehicle motion vector (speed and direction) generated by the GPS receiver 610 to yield absolute wind speed and direction independent of the vehicle motion, i.e., absolute wind velocity. The absolute wind velocity signal is then fed on line 616 from the wind speed and direction processor 612 to the computer 606 where it is utilized, for example, in conjunction with a wind chill lookup table in the database 608 to determine a correction factor to be applied to the freeze point determination for the surface material information as provided by the computer 216 described above. This may be useful, for example, in those locations where the roadway surface may be subject to high winds. In addition, the historical data provided in the database 608 may be used to indicate to the central computer 218 that the particular location, as determined by the GPS receiver in conjunction with geographical information system data stored in the database 608, historically has required a greater or lesser amount of treatment than would be otherwise be indicated.

The weather monitoring portion 600 may be stationary or vehicle mounted and may include a pressure sensor 618 and pressure processor 619 for determining barometric pressure and altitude, an air temperature sensor 620 and temperature processor 621, and an EMR transceiver 622, directable skyward or directable toward any moisture source. The transceiver 622 may utilize a wide band short range radar or laser based range finder to determine the presence or absence of precipitation near the vehicle 102. The transceiver 622 feeds a moisture quality processor 624 which determines at least one characteristic of the sensed precipitation such as moisture content and precipitation rate. For example, the intensity of reflections detected by the transceiver 622 provides an indication of the precipitation rate and/or moisture content. In addition, the transceiver 622 also feeds a density processor 623. The output of the density processor 623 is connected with the computer 606.

The transceiver output is fed to the processor 624 where the magnitude and character of reflections are analyzed. By evaluating the character of reflections received, the differential between the precipitation state in the air (rain, snow, wet snow, dry snow, sleet, etc.) and the freeze point of the precipitating water or ice or combination once it is deposited on the travel surface, may be more accurately determined. This information is then used by the computer 606 to compensate for and optimize the computation of additional material needed to be deposited on the vehicle travel surface as calculated by the surface condition sensing and treatment system 500.

A humidity sensor 632 may also be provided which is coupled to a humidity processor 634. The humidity processor 634 also receives an air temperature input from the air temperature sensor 620 which, when combined with the humidity sensor output, determines the amount of moisture in the air that has not coalesced into precipitation and determine, in essence, the dew point of the air. The humidity processor output is fed to the computer 606 in order to predict the potential for increase or decrease in the amount of or quality of the precipitation accumulating on the travel surface.

Optionally, a wind speed and direction sensor, dew point indicator and/or temperature sensor may be provided on the vehicle 102 which the computer 216 may use to modify the weather data provided by the remote computer 218/606 in order to tailor application of materials more exactly to local conditions and requirements.

Figure 8A:
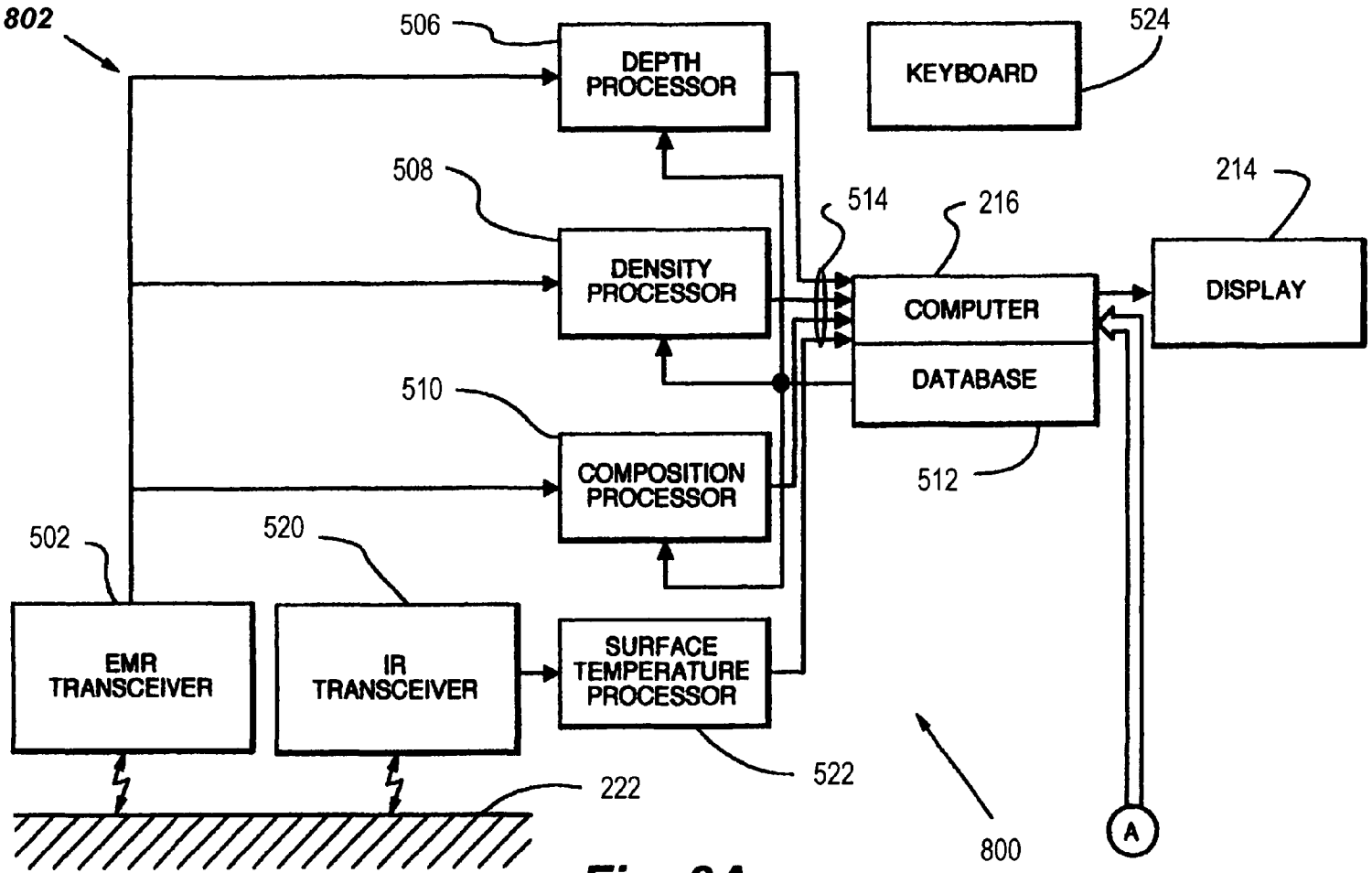
FIGS. 8A and 8B are block diagrams representing one embodiment of a surface condition sensing and treatment system.
Figure 8B:
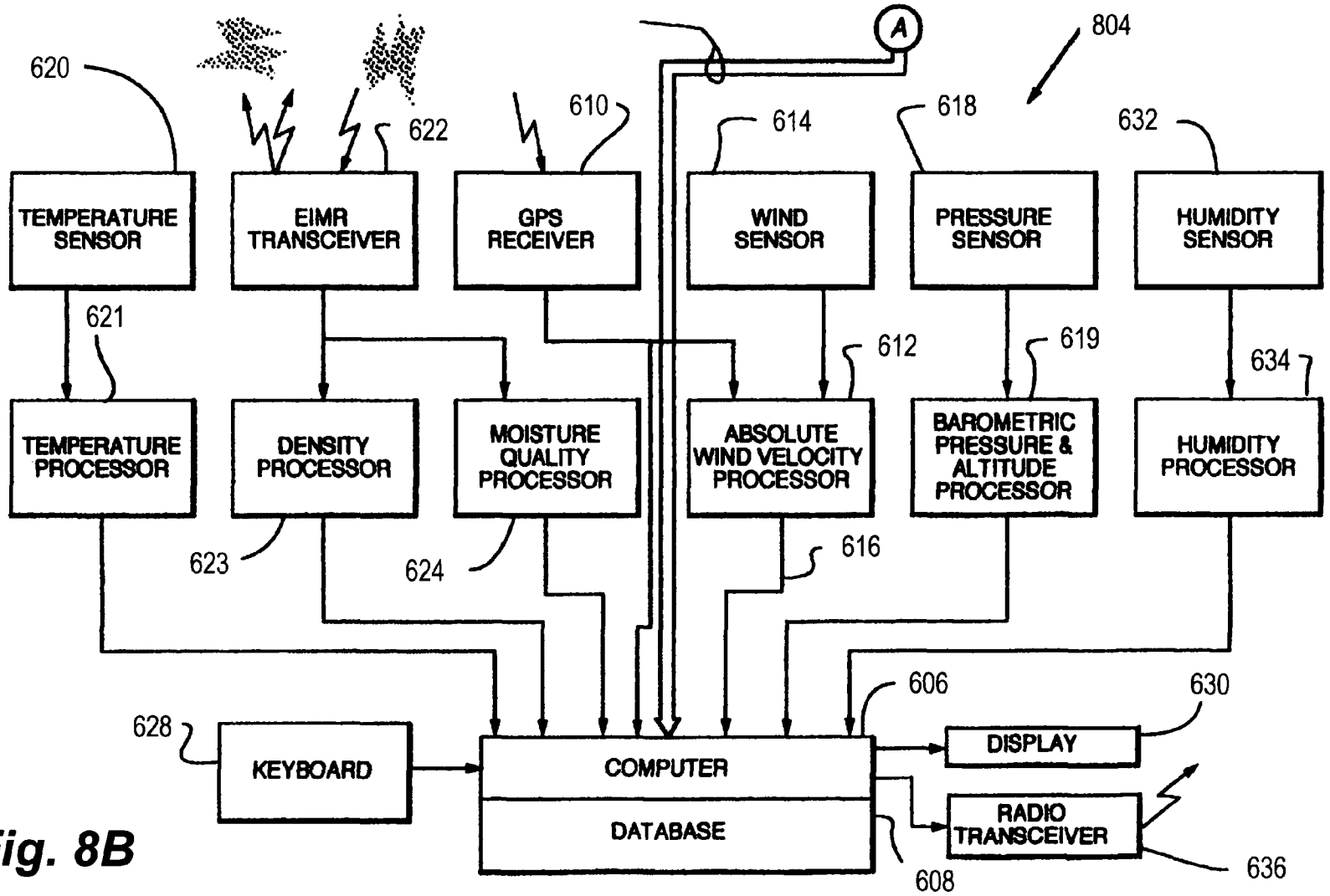

Referring now to FIGS. 8A-8B, in one embodiment, surface condition sensing and treatment system 800 utilizes two separate computers 216 and 606 and databases 512 and 608 and a communication link between the computers and databases. These components communicate, in this example, via bus 826. Either one of the computers 216 or 606 may be programmed to operate or function as a master control and the other as a slave to the overall program of the master control. It should be understood that the computer and database functions described herein may also be combined and provided by a single computer and database, to which each of the sensors and signal processors connects. Therefore, this combined configuration will not be illustrated as it is essentially redundant to what has already been described.

The system 800 may include two separate stand alone systems, portion 802 consisting essentially of the surface condition sensing and treatment system 500, and portion 804 consisting essentially of the vehicle mounted weather monitoring portion 600 (although, as previously noted, weather monitoring portion 600 may also be stationary). As such, the weather monitoring portion 804 may have its own separate input/output devices such as a keyboard 638 and a display 630 (such as keyboard 554 and display 556 of computer 218). Alternatively, keyboard 524 and display 214 may be utilized to provide user control and display functions for both portions 802 and 804 via bus 826. In addition, the system 800 may include a radio transceiver 636 connected to the computer 606 to provide two way remote communications, reporting and control functions to and from a remote command center (not shown) or computer 216. Further, system 800 may include a fixed or mobile system for receiving and/or measuring weather conditions at remote locations or vehicle locations and predicting and forecasting future travel surface conditions to provide recommendations for and verification of surface conditioning activities and results.

FIGS. 9A-9F provide a flowchart depicting software operation according to an embodiment of system 800. It is to be understood that this representation is but one way to utilize the information provided by surface condition sensing and treatment system 802 and weather monitoring portion 804. System 800 provides, via suitable dispensing controls or recommendations to the vehicle operator via the display(s), an optimized treatment plan for the vehicle travel surface (e.g., road or runway surface) depending on actual field conditions.

Generally, the user may choose to set-up both the surface condition sensing and treatment system 800, including enabling the sensors and appointing alert set points, and the vehicle's automatic spreader and plow, or to proceed to the systems operations block 1005 where the system is either set for automatic operations or is bypassed for manual use.

The user (driver) enters the vehicle and turns on the ignition. System 800 powers up and begins the sequence in operation 904, as shown in FIG. 12A. After system 800 is started, the user is queried in operation 906 if entry into set-up mode is desired. If yes, control transfers to operation 908 which requires the user to enter a pre-programmed access code. When a code is entered, control then transfers to operation 910 where the entire code is compared to a previously stored code. If the user unsuccessfully enters the access code, control transfers via line 912 back to the query block 908. The user is given three tries at entering the proper access code. After the third unsuccessful attempt to enter the proper access code, the user is automatically transferred to the operations 1005. It is also contemplated that a third failed attempt to enter the access code may result in the automatic shut down of the software decision flow block and potentially the vehicle ignition is automatically turned off, until it is re-set by the user's supervisor.

If the proper code is successfully entered, control transfers to operation 914 where the user is queried as to whether the current access code should be changed. An affirmative answer transfers control to operation 916 which requires the user to enter a new code. Once the new code has been entered, control transfers back to operation 914, affording the user the opportunity to continue changing the new code until the user is satisfied.

Upon entering the new code, or if the user declines to change the old code, the user is queried in operation 918 whether the sensor systems associated with the vehicle need to be configured. A negative response to query operation 918 will bypass the sensor system setup operational blocks and transfer control via line 928, to operation 1001 to configure automatic spreader and plow control.

Figure 9A:
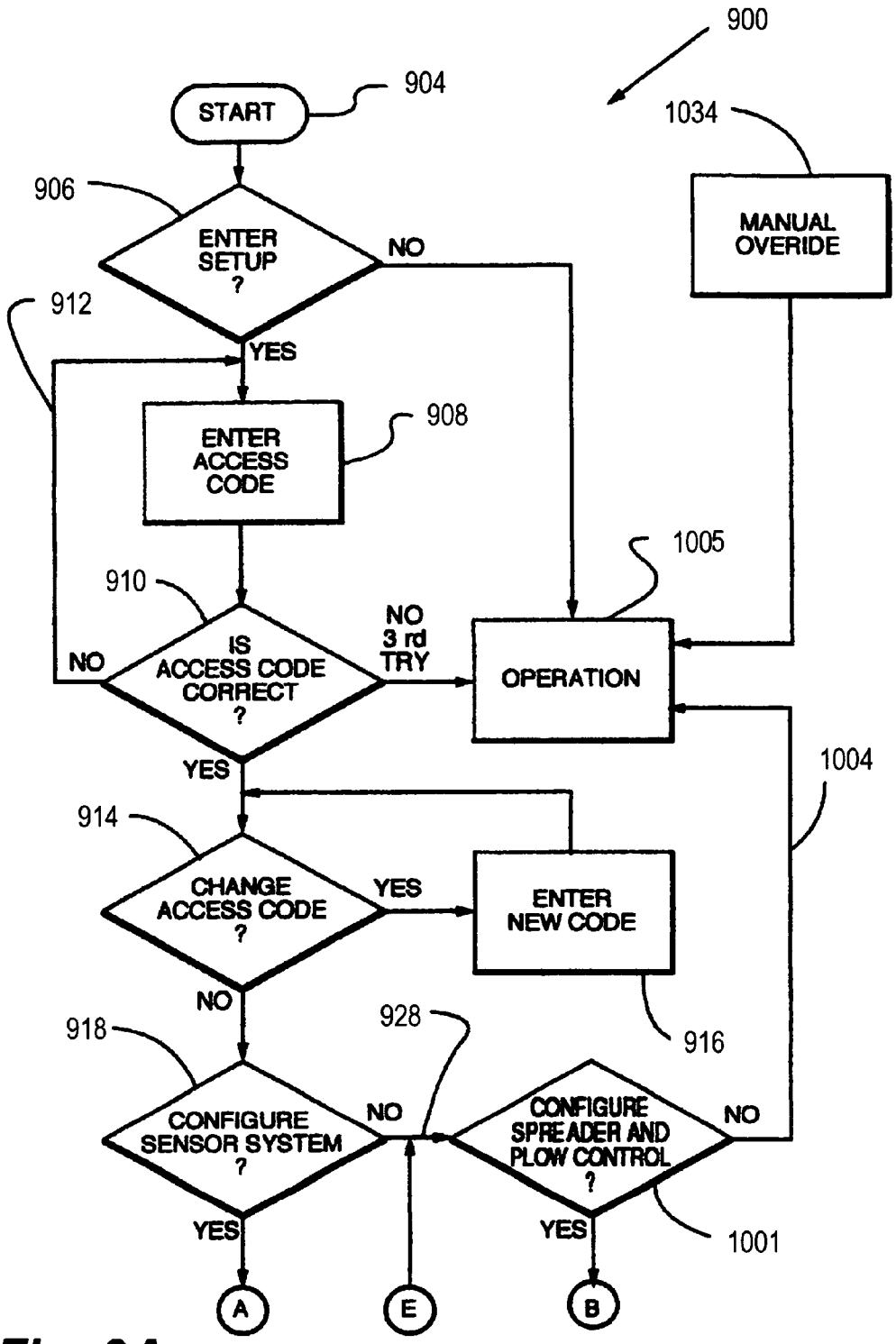
FIGS. 9A-9F illustrate software block diagrams in an embodiment of a surface condition sensing and treatment system.
Figure 9B:
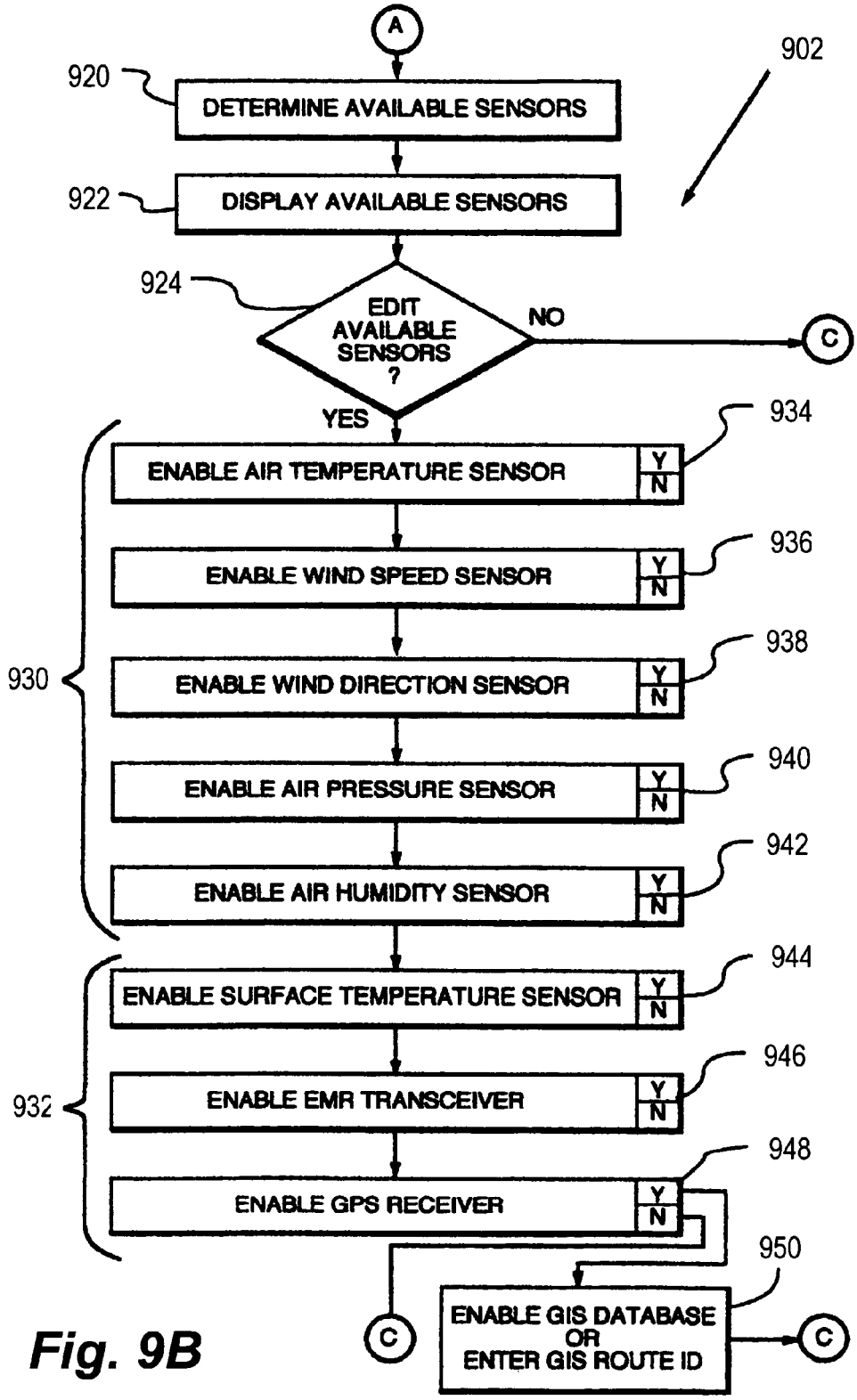
Figure 9C:
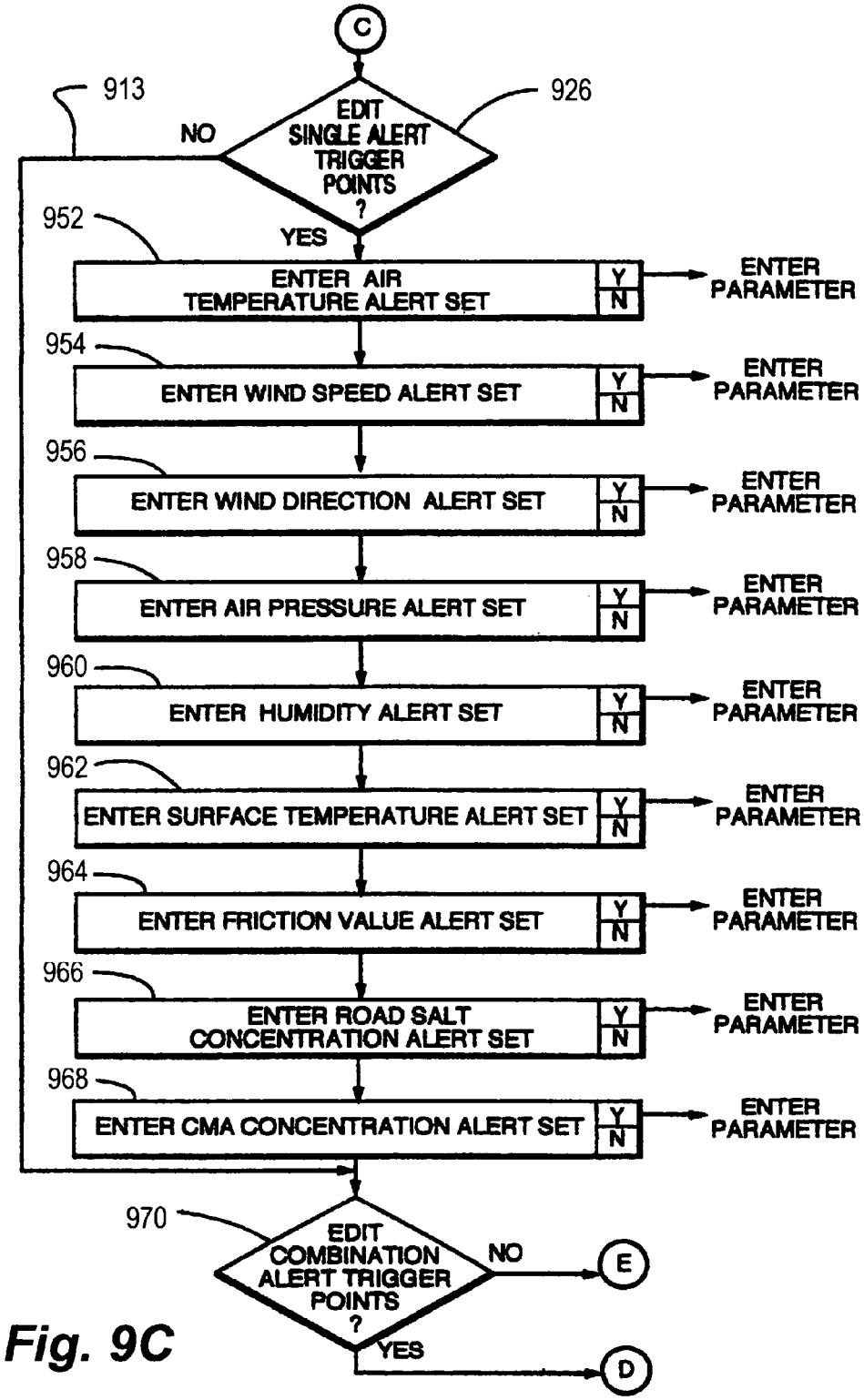
Figure 9D:
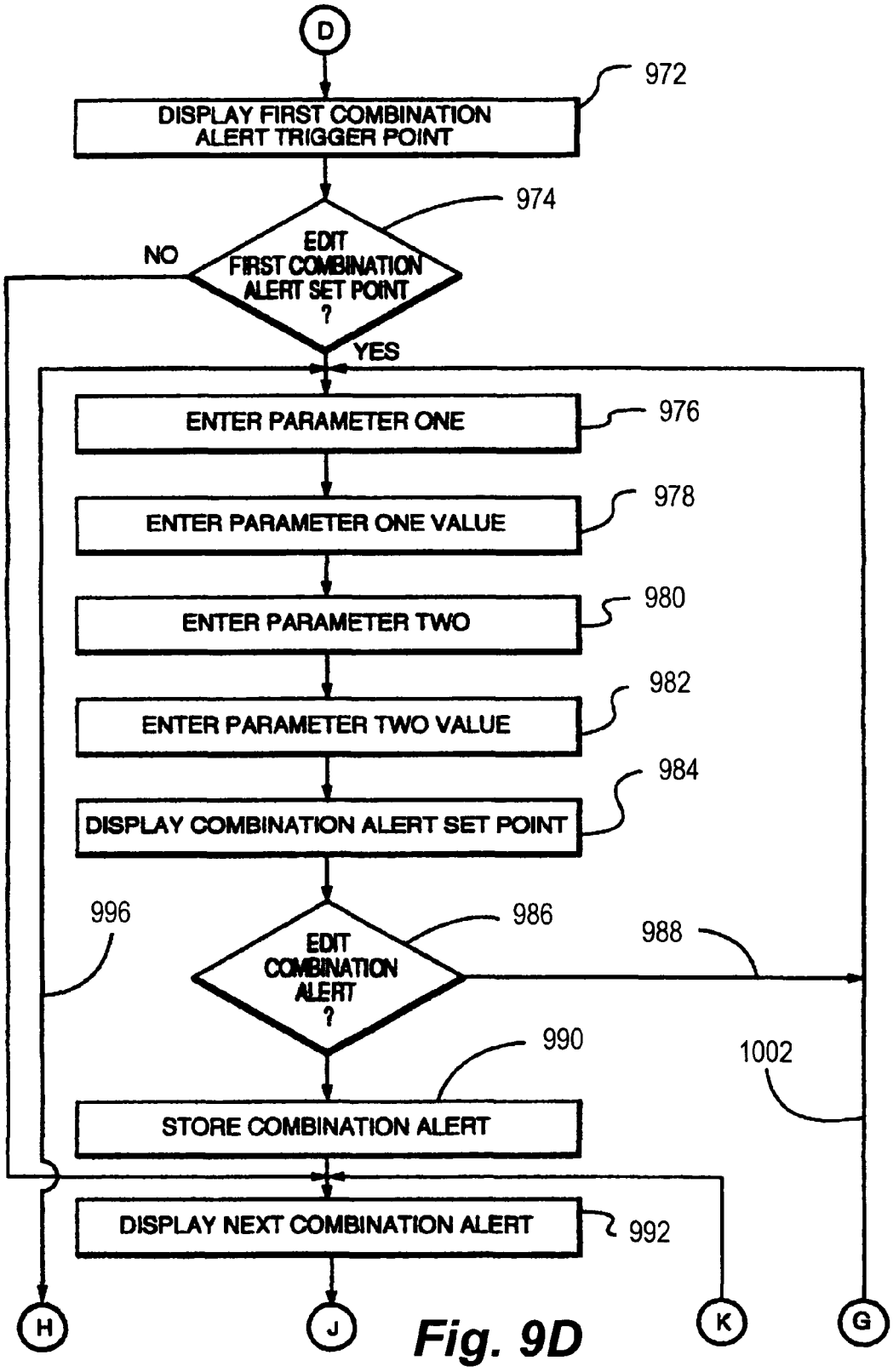

A positive response to query operation 918 transfers control to operation 920 in FIG. 9B. Here, the user may configure or reconfigure the sensor system. The available sensors may either be entered manually by the user, or the program may automatically scan the sensor hook-ups and communication links to determine the available system sensors 920. Once the available sensors are determined, a list of each sensor is displayed in block 922. The user is then queried in operation 924 as to whether to edit the available sensors. If the user does not wish to edit the available sensors, the program control transfers to operation 926 in FIG. 9C, where the user is asked whether any single alert trigger points are to be edited.

If the user does want to edit the available sensors in operation 924 control transfers the user to the first of the enabling block queries 934. By following the programs progression, the user will be allowed to enable any available sensor installed on the vehicle.

Each sensor enabled operation block corresponds to either one of the environmental monitoring sensors 930 or to one of the remote surface condition monitoring sensors 932. For example, environmental monitoring system sensors may include: air temperature sensor 934, wind speed sensor 936, wind direction sensor 938, air pressure sensor 940 and air humidity sensor 942. The remote surface condition monitoring system sensors 932 may include: surface temperature sensor 944, EMR transceiver 946, and GPS receiver 948.

The user simply scrolls through the sensors and indicates, for example by keystroke, which of the available sensors to activate. Enablement of a sensor may key enablement of another related sensor or associated database or function. For example, enablement of the GPS receiver 948 may trigger enablement of a separate enter GIS route number, or enable GIS database, query operation 950, wherein a particular preprogrammed course, corresponding to the potential route the vehicle may travel, may be requested. The course data may have been previously stored in GIS format in the system computer database 512 or 608. Further, once the course has been chosen, the control system, reading position information from the GPS receiver, and relating this to the GIS data, may adjust the fluid material spread width or rate to the known optimal dimensions and automatically deposit one or more desired materials or material types and amounts at the appropriate locations as the vehicle travels past the location. Optionally, a user may intervene and manually adjust fluid material selection, spread width, rate or direction.

It is envisioned that the set of sensors shown in FIG. 9B is not an exclusive list of possible sensors, but rather serves as an example of one possible series of sensors that a user may wish to have the opportunity to enable.

Once the available sensors have been configured, control transfers to operation 926 where the user is queried to edit the available single alert trigger or alert set points. See FIG. 9C. If the user desires to edit the set points, control transfers sequentially through operations 952-968 where the opportunity to edit each set point is provided. Each trigger point block corresponds either to an enabled sensor, or to one of the inherent, and thus always enabled, trigger points that correspond to the system. Possible trigger points may include: an air temperature alert set point 952, a wind speed alert set point 954, a wind direction alert set point 956, an air pressure alert set point 958, a humidity alert set point 960, a roadway surface temperature alert set point 962, a travel surface friction value alert set point 964, a road salt concentration alert set point 966 and a CMA concentration alert set point 968. If no editing of sensor set points is desired, control simply bypasses these operations, shown as line 913.

A user may wish to have alert set points triggered by a particular combination of incoming data from multiple sensors. Accordingly, after each individual single sensor set point has been entered in operations 952-968, the user is queried in operation 970 whether any combination alert set points are desired. If one or more combination set points is desired, operation 970 control transfers to a first combination alert set point block 972 in which a set point will be displayed for the first combination alert. The user will be queried in operation 974 as to whether the first combination alert set point should be edited. If the user gives an affirmative answer to query block 974, the user will be requested, in operation 976, to enter parameter (sensor) one and then in operation 978, enter the set alert value for parameter one, control then transfers to operation 480 where parameter two is identified and the set alert value for parameter two is inputted in operation 982. Once both parameters and their set alert values have been entered, the program will display the results in block operation 984. The user is queried whether to edit the displayed parameter combination in operation 986. An affirmative answer to this query will transfer, via line 988, back to block 976, where the user may edit parameter one by reentering the parameter one. The program will then proceed again through blocks 978, 980, 982, 984 and 986 until the user is satisfied with the displayed combination. When the user is satisfied with the displayed results by no further editing in operation 986, control transfers to operation 990 where the combination is stored.

Practically an unlimited number of parameter combination sets and corresponding alert set point values may be entered onto the system. Upon storing the first combination set point in operation 990 the program will display the next combination alert set point in operation 992. The user is then queried in operation 994 as to whether the displayed combination alert set point should be edited. An affirmative answer will transfer the user, via line 996 back to operation 976, to enter the parameter. The user may then proceed through the same operations 978-990 for this second combination as was performed for the first combination set point.

If the user does not wish to edit the second or next combination alert set point in operation 994, the program may query the user as to whether there is another combination set point contemplated in operation 998. An affirmative answer by the user results in transfer back to operation 992 where the program may display a next combination alert set point. This procedure will continue until the user enters a negative response to the query in operational block 998.

Once a negative response is entered at query block 998 control transfers to operation 1000, where the user is queried as to whether a new and unique combination of alert set points is desired. If a new combination is requested the user is transferred, via line 1002 back to operation 976, to enter parameter one of the combination, and the user may once again proceed through the steps to create a new combination set point pair. A negative response transfers the user, via line 928 in FIG. 9A to operation 1001 where the user is queried whether to configure spreader and plow control.

It is envisioned that parameter multiples of other than two may also be used by the system, thus a user may wish to enter combinations of three or more parameters that interact to give unique alert set point combinations. In this case, an additional set of operational blocks may be inserted between operations 982 and 984.

Once the user has either configured or by-passed the sensor system configuration, the set-up menu proceeds to query the user in operation 1001 whether to configure a snow removal device such as an automatic spreader and/or plow control system. Each automatic spreader and plow configuration operational block will query the user as to whether a particular spreader or plow use should be enabled. Each query may allow the user to enter a yes or no as to enablement. If the user wishes to by-pass the spreader and plow configuration blocks, a negative answer at block 1001 will cause the program to proceed directly to the vehicle operational block 1005, as is shown by line 1004. See FIG. 9A.

Figure 9E:
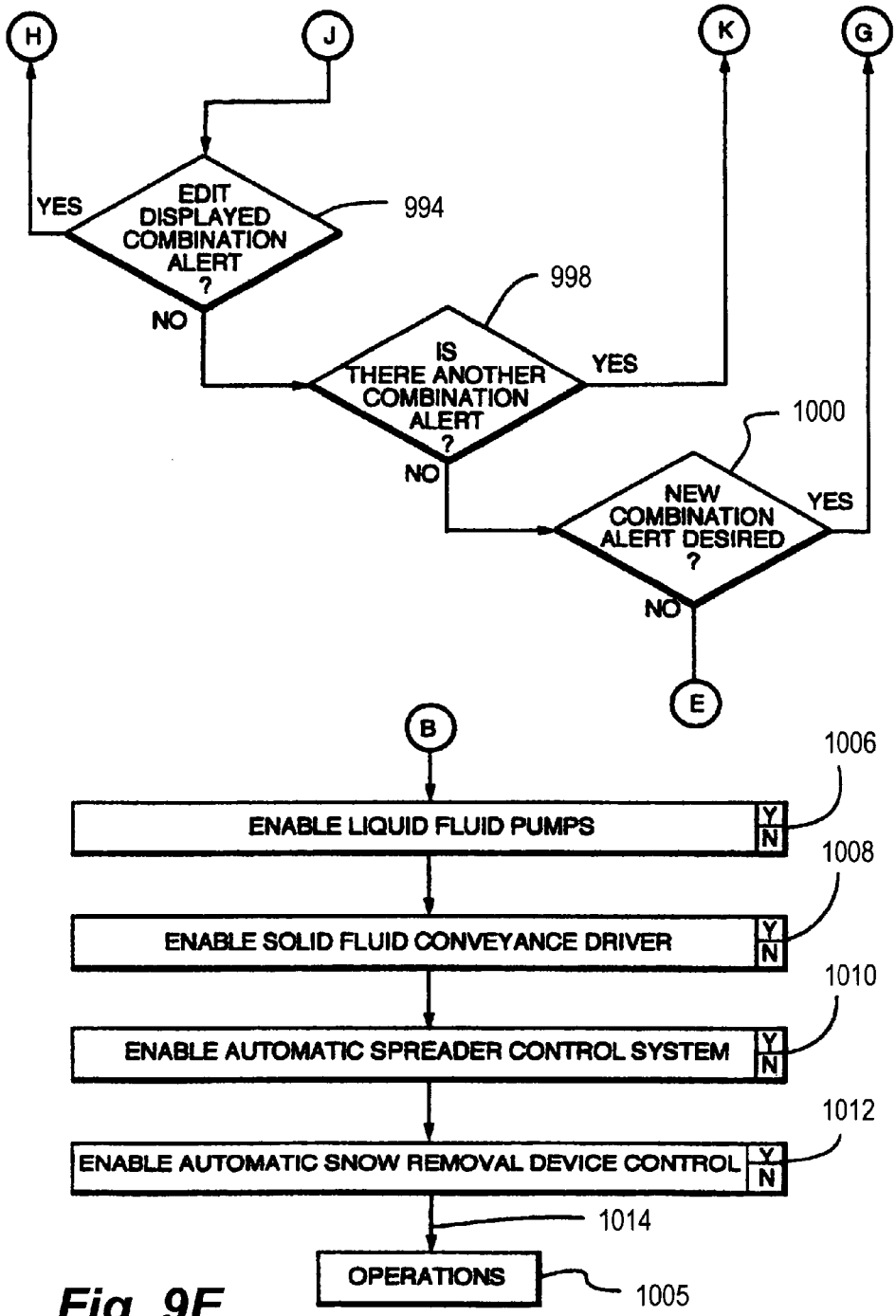

However, should the user desire to edit the configuration of the spreader and plow, control transfers from block 1001 to the series of control operations, as is shown in FIG. 9E. The spreader and plow configuration blocks may include, but are not limited to enabling liquid fluid pump control in operation 1006, enabling the solid fluid conveyance driver in operation 1008, enabling the automatic spreader control system in operation 1010 and enabling the automatic plow control system in operation 1012. These spreader and plow uses and controls are described in more detail in U.S. Pat. No. 5,904,296 Once the user completes the spreader and plow configuration, program control transfers to automatic system operation (e.g., by automatic system 500, system 800, etc.) via operation block 1005, line 1014.

Figure 9F:
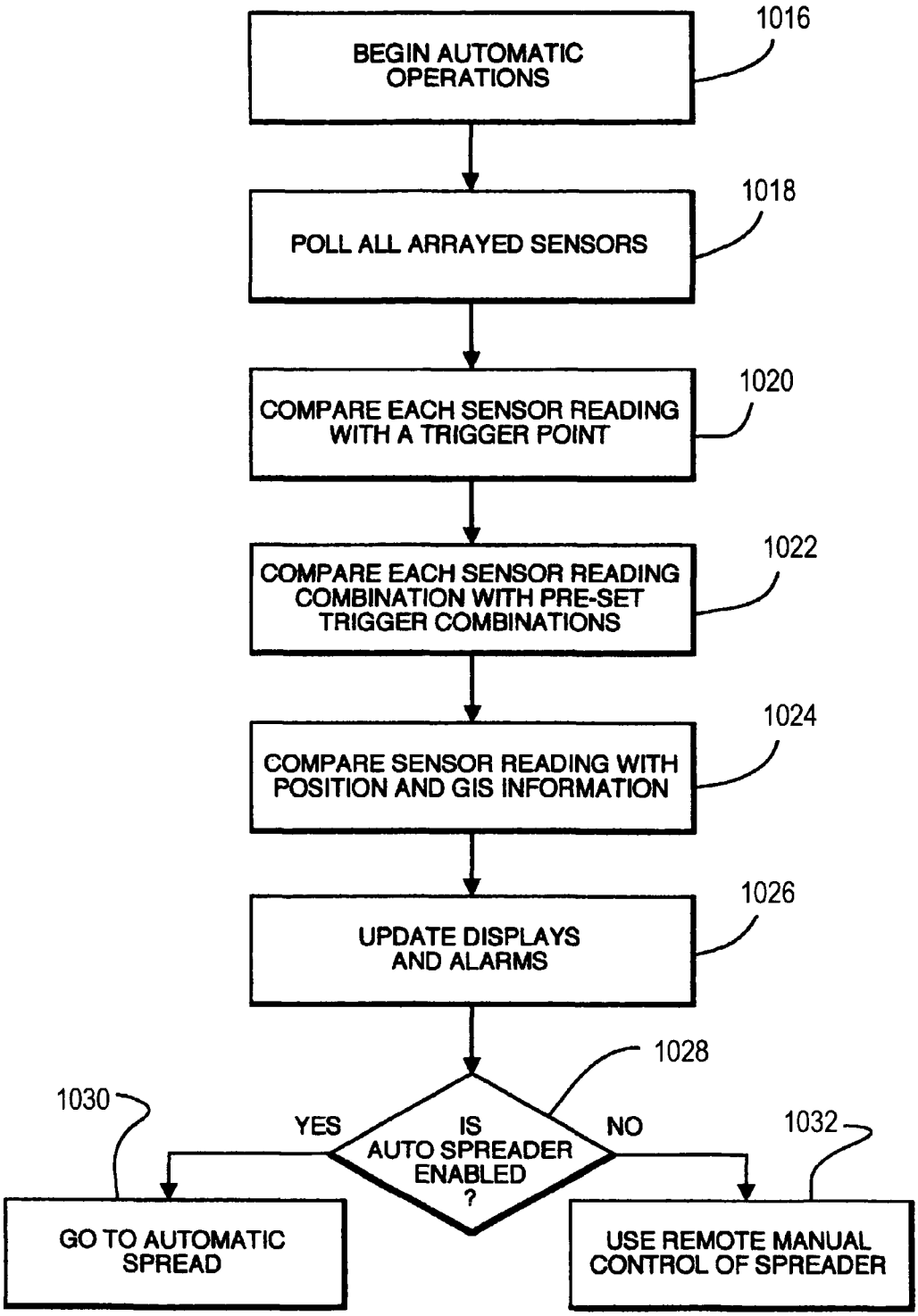

Automatic System Operation block 1005 is shown in more detail in FIG. 9F. Automatic system operation begins in operational block 1016 control then transfers to operation 1018 where the system first polls all of the enabled and arrayed sensors, and then control transfers to operation 1020 where the data from each sensor is compared with that sensor's set alert point. In the case where a combination of set points has been entered, the data collected from the combination of sensors is compared with the combination of alert set points in operation 1022. Control then transfers to operation 1024 where, if the GPS receiver is enabled, the sensor data may also be compared with the vehicle's current location, and/or read in conjunction with the GIS course information. Once all the sensor data has been collected and compared to the alert set points the vehicle sensor displays and alarms are updated in operation 1026. Finally, the user is queried in operation 1028 as to whether the automatic spreader control should be enabled. The user may choose to enable the automatic spreader control in operation 1030 or exercise remote manual control over the spreader in operation 1032.

The operation block 1005 may be engaged automatically at discrete intervals during the operation of the vehicle, or may be engaged when the user determines a need to change or update the surface condition sensing and treatment system during vehicle operation. It is also envisioned that the automatic spreader operations block may be bypassed by a manual override signal block 1034. This block may be implemented by a manual override switch or button located within the vehicle or remote from the vehicle. For example, this override control may be a spring loaded switch designed to simply suspend operations while the vehicle is negotiating an obstacle such as a new construction zone or other situation requiring direct operator input. The remote manual functioning of the surface condition sensing and treatment system, indicated by operation 1032, permits the system to continue to monitor all sensors and display information to the operator without exerting actual automatic control of the surface condition sensing and treatment system, for example, without exerting automatic control of material dispensing and/or plow position. When the switch is released, automatic control resumes.

Figure 10:
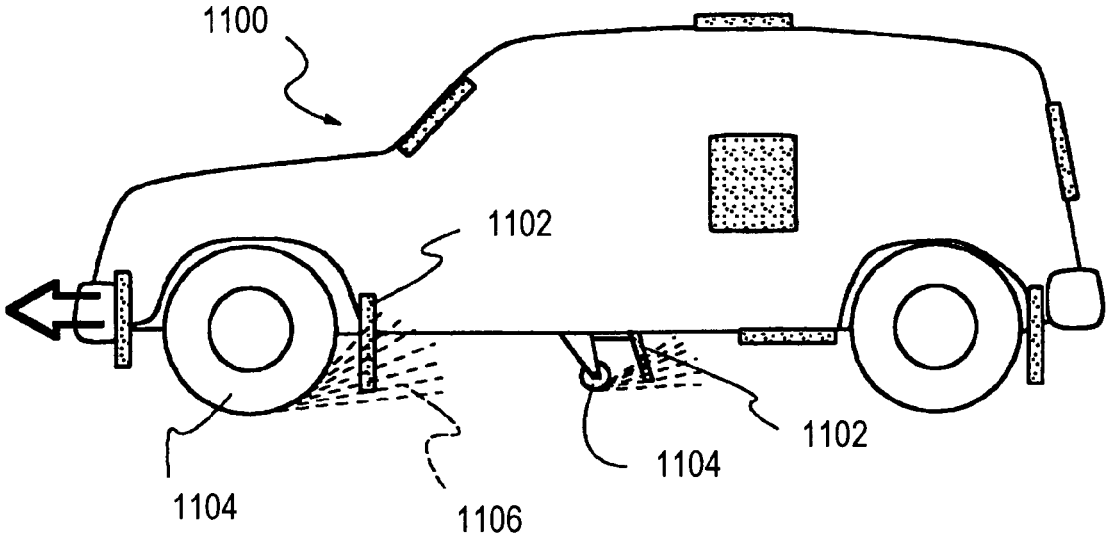
FIG. 10 is a schematic side view of a vehicle showing potential locations for a sensor platform provided with an embodiment of a surface condition sensing and treatment system.

Referring now to FIG. 10, a further embodiment of a surface condition sensing and treatment system includes a platform 1102 which is typically vertically mounted behind a vehicle wheel 1104. This platform 1102 may replace and also operate as a conventional mud flap on the vehicle 1100. One or more sensors, such as sensor 200, FIG. 2, may be mounted upon or incorporated within platform 1102 such that characteristics of material buildup on the surface may be measured. For example, the general type of material buildup, such as ice, water, chemicals, etc. may be measured via resistivity and/or conductivity in conjunction with temperature. The chemical composition of the material on the road surface may be determined by spectrographic techniques, or by evaluation of EMR reflections. The percent of chemical(s), including water and/or ice, in a solution that has built up on a road surface may be determined by measuring the resistivity and/or conductivity of the collected material covering the sensor or by evaluation of EMR reflections. Further characteristics mentioned herein above, such as friction and depth, may likewise be sensed, for example as described with respect to FIG. 5.

Optionally, characteristics such as the freeze point of the solution may be determined by a software or database comparison, such as a table look-up, when the material components are known. The ambient temperature may also be measured, for example, via a thermometer or thermocouple. The temperature of the solution/material buildup may be measured by any known appropriate sensor means such as a thermometer, thermocouple or infrared sensor mounted on the platform 1102.

The flap 1102 mechanically attaches to the vehicle 1100. The sensor flap 1102 may be designed to temporarily "catch" the discharge material from the vehicle's wheel 1104. Alternatively, a separate sensor wheel 1104A may be provided, for producing material discharge to be collected by a flap 1102A which carries the sensors for making the measurements concerning the surface that the vehicle is riding over as well as detecting any buildup that might be on the surface—even after the buildup has left the surface.

The matter contained in the above description and/or shown in the accompanying drawings should be interpreted as illustrative and not in a limiting sense. Changes may be made in the above systems and methods without departing from the scope thereof. For example, multiple combinations of automatic and manual, local and remote sensing, controlling and displaying fall within the scope of the present surface condition sensing and treatment systems and methods. The following claims address all generic and specific features described herein, as well as all statements of the scope of the present method, system and structure which, as a matter of language, might be said to fall therebetween.

The invention claimed is:

1. A surface condition sensing and treatment system for sensing at least one characteristic of a surface material on a vehicle travel surface, comprising:

a transceiver including a transmitter configured for transmitting electromagnetic radiation toward the surface material, and a receiver for receiving reflected electromagnetic radiation from the surface material;

at least one first signal processor connected to the transceiver for processing data indicative of the reflected electromagnetic radiation to produce output corresponding to the characteristic of the surface material; and a GPS receiver for determining a location of the transceiver.

2. The system of claim 1, further comprising a material spreader for depositing granular or liquid material on the travel surface and at coordinates provided by the GPS receiver, when the characteristic warrants treatment.

3. The system of claim 1, wherein the characteristic comprises friction.

4. The system of claim 3, further comprising a material spreader communicatively connected to the processor, for dispensing one or both of granular and liquid material on the travel surface, to increase the friction.

5. The system of claim 1, wherein the characteristic comprises composition of the surface material.

6. The system of claim 5, further comprising a material spreader communicatively connected to the processor, for dispensing one or both of granular and liquid material on the travel surface, to modify the composition.

7. The system of claim 1, wherein the characteristic comprises an amount or percentage of one or both of ice and snow.

8. The system of claim 7, further comprising a material spreader communicatively connected to the processor, for dispensing one or both of granular and liquid material on the travel surface, to melt the ice and snow.

9. The system of claim 1, wherein the characteristic comprises depth of the surface material.

10. The system of claim 1, wherein the characteristic comprises density of the surface material.

11. The system of claim 1, wherein one or more of the transmitter, receiver and processor are remotely controllable.

12. The system of claim 1, wherein one or more of the transmitter, receiver and processor are locally controllable.

13. The system of claim 1, further comprising a database of surface material property data, the processor configured to utilize the database to compare data from the receiver in determining the characteristic.

14. A surface condition sensing and treatment system for sensing at least one characteristic of a surface material on a vehicle travel surface, comprising:

a transmitter configured for transmitting electromagnetic radiation toward the surface material;

a receiver for receiving reflected electromagnetic radiation from the surface material;

at least one first signal processor connected to the receiver for processing data indicative of the reflected electromagnetic radiation to produce output corresponding to the characteristic of the surface material; and a database of surface material property data and level of service data, the processor configured to utilize the database to compare data from the receiver in determining the characteristic and to select a treatment from one or more treatment options for modifying the determined characteristic to achieve a desired level of service, if warranted.

15. The system of claim 14, further comprising a temperature sensor, wherein the treatment options comprise temperature-dependent treatment options for modifying the determined characteristic to achieve a desired level of service.

16. The system of claim 14, further comprising a display for displaying one or more of the output corresponding to the characteristic of the surface material, the determined characteristic, the desired level of service and the treatment options.

17. A method for remotely sensing one or more characteristics of a travel surface, comprising:

transmitting electromagnetic radiation toward a surface material on the travel surface;

receiving reflected electromagnetic radiation from the surface material; and processing data indicative of the reflected electromagnetic radiation to produce output corresponding to the one or more characteristics of the surface material; wherein the transmitting, receiving and processing steps are performed on a vehicle; and utilizing GPS to determine a location of the vehicle.

18. The method of claim 17, further comprising remotely initiating the steps of transmitting, receiving and processing.

19. The method of claim 18, remotely initiating comprising initiating the steps of transmitting, receiving and processing from:

a cab of the vehicle, or a remote computer.

20. The method of claim 17, further comprising applying one or both of granular and liquid material to the travel surface according to the one or more characteristics, or the location.

21. The method of claim 20, the characteristic comprising freezing point of a material on the travel surface; wherein applying comprises applying one or both of granular and liquid material to the travel surface to lower the freezing point.

22. The method of claim 20, further comprising passively sensing temperature of a material on the travel surface; wherein applying comprises adjusting a spread rate of the liquid or granular material to the travel surface based upon the temperature.

23. The method of claim 17, further comprising recommending a surface treatment according to the one or more characteristics, or the location.

24. The method of claim 23, further comprising applying the recommended surface treatment.

25. The method of claim 24, wherein applying the recommended surface treatment comprises automatically applying the recommended surface treatment.

26. The method of claim 25, wherein automatic application is controlled by one or both of an on-board computer and a remote computer.

27. The method of claim 24, wherein applying the recommended surface treatment comprises manually applying the recommended surface treatment.

28. The method of claim 24, wherein applying the recommended surface treatment comprises applying the recommended surface treatment at a chosen point in the future.

29. The method of claim 28, wherein applying the recommended surface treatment at a chosen point in the future comprises postponing application until a selected condition is detected.

30. The method of claim 24, wherein applying the recommended surface treatment is manually initiated by a remote third party, via a remote computer in communication with a vehicle carrying the recommended surface treatment.

31. The method of claim 23, recommending the at least one surface treatment comprising recommending one or both of a type or a quantity of surface treatment material.

32. The method of claim 23, recommending the at least one surface treatment comprising recommending to one or more of an operator of a vehicle carrying the surface treatment, a remote computer and an alternate service vehicle.

33. The method of claim 23, recommending the at least one surface treatment comprising displaying the recommended surface treatment.

34. The method of claim 23, further comprising applying an alternate surface conditioning treatment.

35. The method of claim 34, wherein applying the alternate surface conditioning treatment comprises manually overriding a command to automatically apply the recommended surface conditioning treatment.

36. The method of claim 17, further comprising determining a conditioning treatment for the travel surface based upon one or more of (a) the characteristics and (b) the location of the vehicle.

37. The method of claim 17, further comprising determining a conditioning treatment for the travel surface based upon one or more of (a) the characteristics and (b) a predetermined requirement for the location of the vehicle.

38. The method of claim 17, further comprising receiving weather information and determining a conditioning treatment for the travel surface based upon one or more of (a) the characteristics and (b) the weather information.

39. The method of claim 17, the one or more characteristic comprising one or more of temperature, freeze point, friction, composition of the surface material, amount or percentage of ice, density and depth of the surface material.

40. The method of claim 17, further comprising utilizing a historical database to determine historical surface conditions at a location of the vehicle.

41. The method of claim 40, further comprising:

determining a conditioning treatment for the travel surface based upon one or more of (a) the characteristics and (b) the historical surface conditions; and applying one or both of liquid and granular material to the travel surface based upon one or more of (a) the characteristics and (b) the historical surface conditions.

42. The method of claim 41, further comprising updating the historical database with data indicating the materials applied to the travel surface at the location.

43. The method of claim 42, further comprising transmitting the data indicating the materials applied to the travel surface at the location from the vehicle to a second vehicle.

44. The method of claim 40, the historical database including past weather conditions at the location, past characteristics sensed at the location or past surface treatments applied at the location.

45. The method of claim 17, further comprising determining a conditioning treatment for the travel surface based upon the characteristic, when the characteristic warrants treatment.

46. The method of claim 45, the characteristic selected from the group of depth, density, friction, composition, an amount or percentage of ice or snow, freezing point and temperature;

wherein determining a conditioning treatment comprises determining a spread rate of one or more liquid or granular materials to the travel surface.

47. The method of claim 17, the characteristic comprising freezing point of the surface material, wherein determining comprises determining a conditioning treatment to lower the freezing point.

48. The method of claim 17, the characteristic comprising a chemical composition of the surface material, further comprising determining the freeze point of the material, according to the chemical composition.

49. The method of claim 17, the vehicle comprising a commuter vehicle or a passenger vehicle.

50. The method of claim 17, wherein sensing comprises sensing while the vehicle and the travel surface are in relative motion.

51. The method of claim 17, further comprising utilizing a historical database to determine one or both of (a) a past surface treatment applied and (b) a past surface condition sensed at a location of the vehicle.

52. The method of claim 51, wherein utilizing the historical database to determine a past surface treatment applied comprises determining a rate of application of the past surface treatment.

53. A surface condition sensing and treatment system for sensing at least one characteristic of a surface material on a vehicle travel surface, comprising:

a transmitter configured for transmitting electromagnetic radiation toward the surface material;

a receiver for receiving reflected electromagnetic radiation from the surface material;

at least one first signal processor connected to the receiver for processing data indicative of the reflected electromagnetic radiation to produce output corresponding to the characteristic of the surface material;

a passive temperature sensor; and a database of surface material property data and level of service data, the processor configured to utilize the database to compare data from the receiver in determining the characteristic and to select a treatment from one or more temperature-dependent treatment options for modifying the determined characteristic to achieve a desired level of service.

54. A method for remotely sensing one or more characteristics of a travel surface, comprising:

transmitting electromagnetic radiation toward a surface material on the travel surface;

receiving reflected electromagnetic radiation from the surface material;

processing data indicative of the reflected electromagnetic radiation to produce output corresponding to the one or more characteristics of the surface material;

accessing a treatment database containing treatment data; and processing the output corresponding to the one or more characteristics of the surface material with the treatment data; and selecting at least one surface treatment from the treatment data, to modify the one or more characteristics, when the characteristic warrants treatment.

55. The method of claim 54, wherein accessing, processing and selecting are performed from a vehicle.

56. The method of claim 54, wherein accessing, processing and selecting are performed from a remote computer.

57. A method for remotely sensing one or more characteristics of a travel surface, comprising:

transmitting electromagnetic radiation toward a surface material on the travel surface;

receiving reflected electromagnetic radiation from the surface material;

processing data indicative of the reflected electromagnetic radiation to produce output corresponding to the one or more characteristics of the surface material; wherein the transmitting, receiving and processing steps are performed on a vehicle;

utilizing GPS to determine a location of the vehicle;

accessing a treatment database containing treatment data; and determining at least one conditioning treatment to modify a condition of the travel surface based on the treatment data and one or both of the location and the sensed characteristic.

58. The method of claim 57, further comprising receiving or monitoring at least one weather condition and processing information representative of the weather condition with the treatment data and one or both of the location and the sensed characteristic, to determine the at least one conditioning treatment.

59. The method of claim 58, further comprising recommending the at least one determined conditioning treatment, for application to the travel surface.

60. The method of claim 58, the at least one received or monitored weather condition selected from the group of wind chill, moisture type, moisture content, wind speed, wind direction, barometric pressure, air temperature, precipitation rate, precipitation state and humidity.

61. The method of claim 60, wherein precipitation state indicates one or more of rain, snow, wet snow, dry snow and sleet.

62. The method of claim 57, further comprising accessing a historical database, wherein the at least one conditioning treatment is determined based upon the historical data, the treatment data and one or both of the location and the sensed surface condition.

63. The method of claim 62, further comprising recommending the at least one determined conditioning treatment.

64. The method of claim 63, further comprising receiving or monitoring a weather condition, wherein the at least one conditioning treatment is determined based upon the weather condition, the treatment data, the historical data, and one or both of the sensed characteristic and the location, wherein recommending comprises recommending the at least one determined conditioning treatment for future application to the vehicle travel surface.

65. A method for remotely sensing one or more characteristics of a travel surface, comprising:

transmitting electromagnetic radiation toward a surface material on the travel surface;

receiving reflected electromagnetic radiation from the surface material; and processing data indicative of the reflected electromagnetic radiation to produce output corresponding to the one or more characteristics of the surface material; wherein the transmitting, receiving and processing steps are performed on a vehicle;

utilizing GPS to determine a location of the vehicle;

transmitting the location from a computer on board the vehicle to a remote computer;

processing the characteristic with the vehicle location, at the remote computer to determine a conditioning treatment for the travel surface based upon one or more of (a) the characteristics and (b) the location of the vehicle; and transmitting the conditioning treatment from the remote computer to the on-board computer.

66. The method of claim 65, the conditioning treatment comprising one or more liquid or granular materials.

67. The method of claim 65, the conditioning treatment comprising plowing.

68. The method of claim 65, wherein determining a location, sensing a characteristic and determining a conditioning treatment are locally controlled.

69. The method of claim 65, wherein determining a location, sensing a surface condition and determining a conditioning treatment are remotely controlled.

70. A surface condition sensing and treatment system for sensing at least one characteristic of a surface material on a vehicle travel surface, comprising:

a transmitter configured for transmitting electromagnetic radiation toward the surface material;

a receiver for receiving reflected electromagnetic radiation from the surface material;

at least one first signal processor connected to the receiver for processing data indicative of the reflected electromagnetic radiation to produce output corresponding to the characteristic of the surface material;

a passive temperature sensor;

a GPS receiver for determining a location of the transmitter and receiver;

wherein the processor processes the output corresponding to the characteristic with temperature information from the temperature sensor and location information from the GPS receiver to determine one or more treatment options for modifying the determined characteristic.

* * * * *